US008446403B2

(12) United States Patent
Tsuchi et al.

(10) Patent No.: US 8,446,403 B2
(45) Date of Patent: May 21, 2013

(54) DECODER AND DATA DRIVER FOR DISPLAY DEVICE USING THE SAME

(75) Inventors: Hiroshi Tsuchi, Kanagawa (JP); Nobuyasu Doi, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 289 days.

(21) Appl. No.: 13/027,450

(22) Filed: Feb. 15, 2011

(65) Prior Publication Data

US 2011/0205218 A1 Aug. 25, 2011

(30) Foreign Application Priority Data

Feb. 19, 2010 (JP) ..... 2010-035109

(51) Int. Cl.
*G09G 5/00* (2006.01)

(52) U.S. Cl.
USPC ..... 345/212; 345/204; 345/211

(58) Field of Classification Search
USPC ..... 345/204, 211, 212; 365/185.23
See application file for complete search history.

(56) References Cited

U.S. PATENT DOCUMENTS 6,417,827 B1 7/2002 Nagao et al.

FOREIGN PATENT DOCUMENTS

JP 2000-250490 A 9/2000

*Primary Examiner* — Amare Mengistu
*Assistant Examiner* — Premal Patel
(74) *Attorney, Agent, or Firm* — Foley & Lardner LLP

(57) ABSTRACT

Disclosed is a decoder, receiving the first and the second reference voltage groups and selecting a reference voltage in accordance with a received digital signal, including a first sub-decoder receiving the first reference voltage group, a second sub-decoder receiving the second reference voltage group 20B, and a third sub-decoder receiving a reference voltage selected by the second sub-decoder and outputting the selected reference voltage to the first sub-decoder or an output terminal of the decoder. The first sub-decoder includes a transistor of a first conductivity type having a back gate supplied with a first power supply voltage, the second sub-decoder includes a transistor of the first conductivity type having a back gate supplied with a second power supply voltage, and the third sub-decoder includes a transistor of the first conductivity type having a back gate supplied with a first power supply voltage.

19 Claims, 20 Drawing Sheets

DECODER AND DATA DRIVER FOR DISPLAY DEVICE USING THE SAME

TECHNICAL FIELD

Reference to Related Application

This application is based upon and claims the benefit of the priority of Japanese patent application No. 2010-035109, filed on Feb. 19, 2010, the disclosure of which is incorporated herein in its entirety by reference thereto.

The present invention relates to a decoder that receives a plurality of voltage signals and that selects and outputs them based on a digital signal, and a data driver for a display device using the same.

BACKGROUND

FIG. 19 is a diagram for explaining a typical configuration example of a decoder circuit of a data driver that selects a voltage (grayscale voltage) from a plurality of reference voltages based on an image data signal and supplies the selected voltage to a display element in a display panel. In FIG. 19, for the sake of simplification of the explanation, there is shown an example in which the image data signal is a 3-bit digital signal (its High level is a high-potential power supply VDD and its Low level is a low-potential power supply VSS), and the 3-bit data signal and its complementary signal D1/D1B, D2/D2B, and D3/D3B select one voltage from eight reference voltages V1 to V8 in a tournament scheme and output the selected voltage. In other words, the decoder circuit comprises 14 PMOS transistors (pass transistors) that function as switches (transfer gates) which are controlled to be turned on and off by D1/D1B, D2/D2B, and D3/D3B supplied to their gates, and which output the selected voltage when turned on. The magnitude relationship among the high-potential power supply VDD, the low-potential power supply VSS (for instance GND (ground) potential), and the eight reference voltages V1 to V8 is as follows:

$$VDD \geqq V1 > V2 > V3 > \ldots > V8 \geqq VSS.$$

In the configuration shown in FIG. 19, when D1, which is the LSB (the Least Significant Bit), is at a Low level (D1B, the complementary signal of D1, is at a High level), the P-channel transistors 902, 904, 906, and 908 having gates supplied with D1 are turned on, the P-channel transistors 901, 903, 905, and 907 having gates supplied with D1B are turned off, and the reference voltages V2, V4, V6, and V8 are transferred to one ends (for instance a source) of the P-channel transistors 909, 910, 911, and 912, respectively. When D1B is at a Low level (D1=High), the P-channel transistors 901, 903, 905, and 907 are turned on, the P-channel transistors 902, 904, 906, and 908 are turned off, and the reference voltages V1, V3, V5, and V7 are transferred to one ends (for instance a source) of the P-channel transistors 909, 910, 911, and 912, respectively.

When D2 is at a Low level (D2B, the complementary signal of D2, is at a High level), the P-channel transistors 910 and 912 having gates supplied with D2 are turned on, the P-channel transistors 909 and 911 having gates supplied with D2B are turned off, and the voltage V3 or V4 passing through the P-channel transistor 903 or 904 and the voltage V7 or V8 passing through the P-channel transistor 907 or 908 are transferred to one ends (for instance a source) of the P-channel transistors 913 and 914, respectively.

When D2B is at a Low level (D2=High), the P-channel transistors 909 and 911 are turned on, the P-channel transistors 910 and 912 are turned off, and the voltage V1 or V2 passing through the P-channel transistor 901 or 902 and the voltage V5 or V6 passing through the P-channel transistor 905 or 906 are transferred to one ends (for instance a source) of the P-channel transistors 913 and 914, respectively.

When D3 is at a Low level (D3B=High), the P-channel transistor 914 having a gate supplied with D3 is turned on, the P-channel transistor 913 having a gate supplied with D3B is turned off, and a voltage (any one of the voltages V5 to V8) passing through the P-channel transistor 911 or 912 is transferred to a terminal 5.

When D3B is at a Low level (D3=High), the P-channel transistor 913 is turned on, the P-channel transistor 914 is turned off, and a voltage (any one of the voltages V1 to V4) passing through the P-channel transistor 909 or 910 is transferred to the terminal 5.

The high-potential power supply voltage VDD is supplied to back gates of the PMOS transistors 901 to 914. A gate-to-source voltage when a MOS transistor is turned on, i.e., when a channel for carriers is formed (an inversion layer is formed) on a substrate surface directly below a gate oxide film, is called a threshold voltage. Since a gate-to-source voltage of a PMOS transistor has a negative value, a threshold voltage Vtp (<0) of PMOS transistor is treated as an absolute value |Vtp| in terms of magnitude relationship in the below.

A substrate bias effect will be briefly explained. As described in standard textbooks, the threshold voltage of a MOS transistor for a substrate voltage $V_{BS}$ is given by the following expression (1):

$$V_{th} = V_{th0} + \Delta V_{th} \tag{1}$$

$$\Delta V_{th} = \gamma\left(\sqrt{|2\Phi_F + V_{BS}|} - \sqrt{|2\Phi_F|}\right) \tag{2}$$

$V_{th0}$ in the expression (1) is a threshold voltage of an NMOS transistor when the substrate voltage is 0, $\Delta V_{th}$ is the increment when the back gate voltage equals to $V_{BS}$ and given by the expression (2). In the expression (2), γ is a substrate bias effect coefficient and is given by the following expression (3).

$$\gamma = \frac{\sqrt{2q\varepsilon_{Si}N_{sub}}}{C_{ox}} \tag{3}$$

where q is the electron charge, $\epsilon_{Si}$ is a permeability of silicon, $N_{sub}$ is an impurity concentration of the substrate and $C_{OX}$ is a gate capacitance of a unit area. For instance, γ is approximated by $0.4V^{1/2}$ or $0.5V^{1/2}$ in most cases.

Further, $\Phi_F$ in the expression (2) can be given by the following expression (4).

$$\Phi_F = \frac{E_I - E_F}{q} = \frac{kT}{q}\ln\left(\frac{N_{sub}}{n_I}\right) \tag{4}$$

where $E_F$ is a Fermi level, $E_I$ is an intrinsic Fermi level in the midst of the gap, q is the electron charge, $N_{sub}$ is an impurity concentration of the substrate, $n_I$ is a free electron density of intrinsic silicon, k is the Boltzmann Constant, and T is an absolute temperature. For instance, $2\Phi_F$ is treated as a value of approximately 0.7V.

In case of an NMOS transistor, if the back gate voltage Vbn is lowered from a source potential (for instance the GND potential), its threshold voltage Vtn will increase by ΔVth given by the expression (2) as ΔVtn, and conversely if the back gate voltage Vbn is raised from the source potential (GND potential), the threshold voltage Vtn will decrease. In case of a PMOS transistor provided on an N-type silicon substrate, if the back gate voltage is raised higher than the source potential (for instance the power supply voltage VDD), an absolute value |Vtp| of the threshold voltage will increase by ΔVth given by the expression (2), as ΔVtp. Conversely if the back gate voltage of a PMOS transistor is lowered from the power supply voltage VDD, an absolute value |Vtp| of a threshold voltage of the PMOS transistor will decrease (a reduced threshold voltage).

In the decoder shown in FIG. 19, for instance, when the Low voltage (VSS) is applied to the gates of the PMOS transistors 908, 907, 912, and 914 that select the low potential reference voltage such as V8 and V7, the potential applied to the sources of the PMOS transistors 908, 907, 912, and 914 is given as follows: V8=VSS+α or V7=VSS+β (β>α≧VSS), and the PMOS transistors 908, 907, 912, and 914 are not turned on (conductive) when their gate-to-source voltage $|V_{GS}|=|\alpha|$ or $|\beta|$ is less than their threshold voltage |Vtp|. Even if turned on, a propagation delay time of each of the PMOS transistors may increase and an output delay may occur. Further, a gate width (W) of a PMOS transistor needs to be increased in order to decrease an on-resistance $R_{ON}$ thereof. This may be result in an increase of an area.

As is well known, the on-resistance $R_{ON}$ of a MOS transistor can be given by the following expression (5).

$$R_{on} = \frac{1}{\mu_c C_{ox} \frac{W}{L}(V_{GS} - V_{th})} \tag{5}$$

where $\mu_C$ is a carrier mobility (electron in the case of NMOS, while hole in the case of PMOS), $C_{OX}$ is a gate capacitance of a unit area, W is a gate width, L is a gate length, $V_{GS}$ is a gate-to-source voltage, and Vt is a threshold voltage. According to the expression (5), for instance increasing the gate width W, or increasing ($V_{GS}$−Vth) by decreasing Vth will decrease the value of the on-resistance $R_{ON}$.

In the decoder shown in FIG. 19, in order for the PMOS transistors 907 and 908, which receive V8=VSS+α, or V7=VSS+β (β>α>0) at one of their ends and receive the Low level at their gates, to be turned on (electrically conductive), the threshold voltage Vtp of the PMOS transistor must be decreased.

Further, when the threshold voltage of a MOS transistor is decreased in order to widen the selectable voltage range of a decoder circuit of a data driver, a leakage current flows from an output side into the low threshold voltage MOS transistor owing to a grayscale voltage (refer to Patent Document 1). FIG. 20 is quoted from FIG. 5 of Patent Document 1 (Japanese Patent Kokai Publication No. JP-P2000-250490A). Patent Document 1 discloses the configuration in which a MOS transistor M1 arranged in the highest order of a low Vth MOS transistor (M2-M7) of a grayscale group of a decoder circuit of a drain driver to compose a CMOS transfer gate, to prevent a current from flowing from an output side into the low Vth MOS transistor by a grayscale voltage applied to another portion. In FIG. 20, in order to widen the output range of the decoder, MOS transistors M2 to M7 are lowered in Vth. Further, in order to prevent a current from flowing into the low Vth NMOS transistor (a leakage current between a drain and a source) when a reference voltage V9 is selected, the MOS transistor M1 is connected in parallel with a PMOS transistor to compose a CMOS transfer gate.

[Patent Document 1]

Japanese Patent Kokai Publication No. JP-P2000-250490A

SUMMARY

The entire disclosure of Patent Documents 1 is incorporated herein by reference thereto.

An analysis on the related technologies is given below.

It should be noted that the present invention described below prevents a PNP junction leakage whereas the technology disclosed in Patent Document 1 prevents the leakage between a drain and a source in the MOS transistor M1. The physical phenomena treated are completely different.

Patent Document 1 describes that, since the low Vth MOS transistors need to be enhancement MOS transistors at V7, which is the lowest grayscale level of V5 to V7, the lowering in Vth is adjusted by adjusting the amount of the corresponding Vth control ion implantation. As a result, the manufacturing cost increase due to the addition of a mask and an increase in manufacturing processes. Further, when the voltage range of lowered Vth changes, so does the optimal value for the Vth control. Therefore, it is not realistic to adjust the threshold voltage Vth of a transistor according to the condition of variable voltage range in the manufacturing process.

According to the present invention, there is provided a decoder receiving first and second reference voltage groups from a reference voltage generation circuit that outputs the first and second reference voltage groups belonging respectively to first and second voltage sections not overlapping each other, selecting a reference voltage from among the first and second reference voltage groups in accordance with a received digital signal and outputting a selected reference voltage, wherein the decoder includes:

a first sub-decoder receiving the first reference voltage group and selecting and outputting a reference voltage to an output terminal of the decoder, wherein the first sub-decoder comprises a plurality of switches, each which includes a first transistor of a first conductivity type having a back gate supplied with a first power supply voltage;

a second sub-decoder receiving said second reference voltage group, wherein the second sub-decoder comprises a plurality of switches, each of which includes a second transistor of said first conductivity type having a back gate supplied with a second power supply voltage, which is different from said first power supply voltage; and a third sub-decoder receiving at least a reference voltage selected by said second sub-decoder and selecting and outputting a reference voltage to said first sub-decoder or to said output terminal of said decoder, wherein said third sub-decoder comprises at least a switch including a third transistor of said first conductivity type having a back gate supplied with said first power supply voltage. The first power supply voltage is a first reference voltage, which is a voltage most spaced from the second voltage section among the first reference voltage group, or a predetermined voltage having the same magnitude relationship with the second voltage section as the first reference voltage and further spaced from the second voltage section than the first reference voltage. The second power supply voltage is a predetermined voltage within a range from a second reference voltage, which is a voltage closest to the first voltage section among the second reference voltage group, to a voltage within the first voltage section but not reaching the first reference voltage. According to the present invention, there is provided a data driver apparatus comprising the decoder. There is further provided a display device comprising the data driver apparatus.

According to the present invention, a decoder can extend a voltage range of an output signal thereof by supplying a predetermined a back gate voltage to a switch transistor in a sub-decoder of the decoder to decrease a threshold voltage (in absolute value). Further, in addition to the effect above, according to the present invention, an amount of the reduction of the threshold voltage (in absolute value) of a switch transistor can be appropriately controlled by adjusting a back gate voltage thereof according to conditions of a variable voltage range. Moreover, according to the present invention, it is possible to reduce a gate size of a transistor constituting a switch in a decoder and to reduce an area thereof.

Still other features and advantages of the present invention will become readily apparent to those skilled in this art from the following detailed description in conjunction with the accompanying drawings wherein only exemplary embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED MODES

Figure 1:
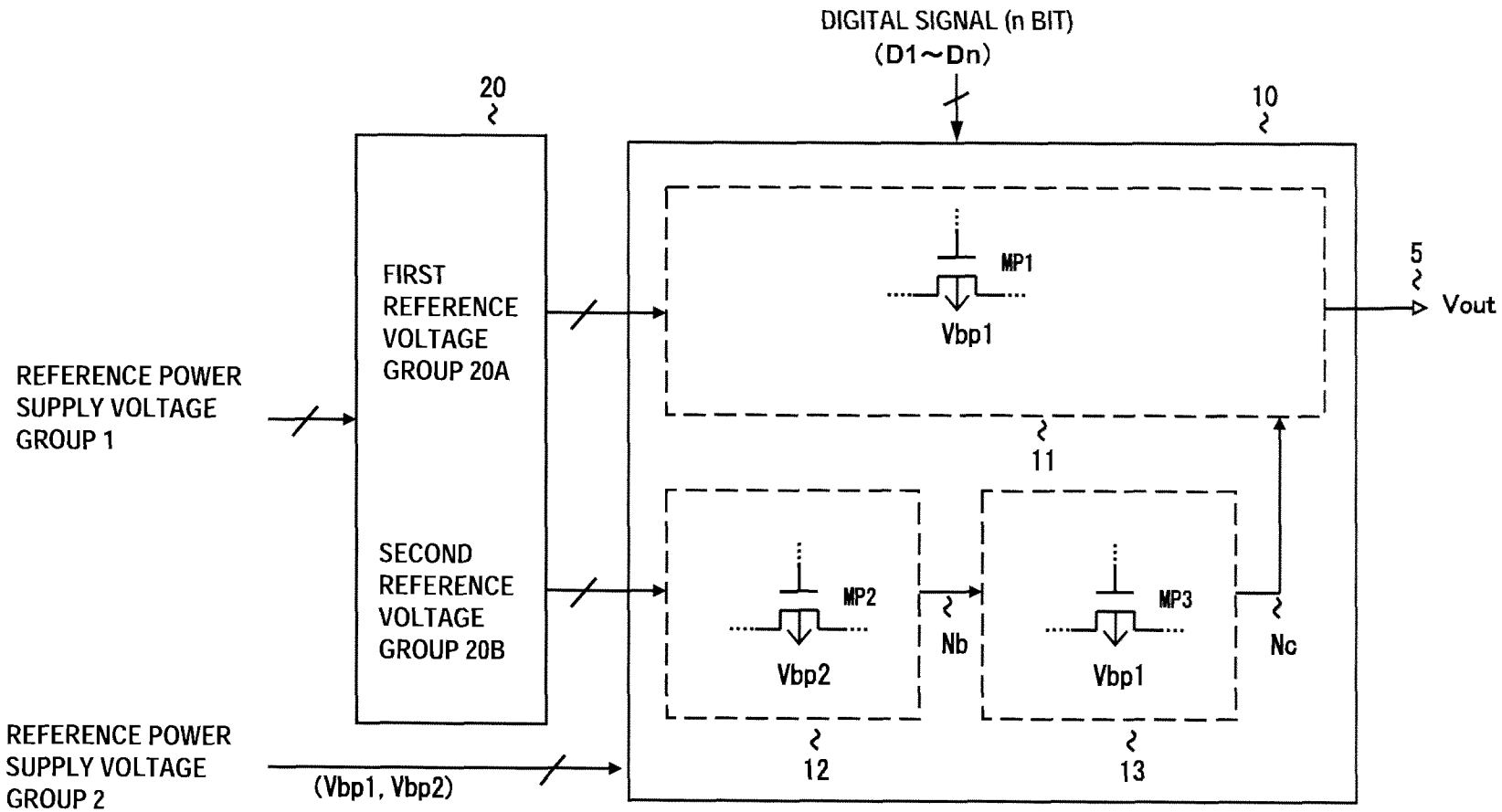
FIG. 1 is a diagram showing a configuration of a first exemplary embodiment of the present invention.

The outline of one of the principles of operation of several embodiments of the present invention will be described. In an effective threshold voltage including a substrate bias effect:

$$Vth = Vth0 + \Delta Vth(V),$$

a decoder circuit according to the present invention restrains an increase in ΔVth (V) by changing selectively a back gate voltage in some transistors according to a selected voltage range, and suppresses an increase in the effective threshold voltage. Vth0 is a threshold voltage when there is no substrate bias effect, and ΔVth (V) is an increment of the threshold voltage due to the substrate bias effect when the back gate voltage is V.

The decoder of the present invention controls an effective threshold voltage of a MOS transistor by changing a back gate voltage of the MOS transistor. Therefore, no additional adjustment on the threshold voltage during the manufacturing process is required and an increase in manufacturing cost is avoided. Further, a gamma voltage generated by a reference voltage generation circuit may be used as an additional back gate voltage supplied to a MOS transistor. In this case, it is not necessary to add a new power supply for supplying additional power to the back gate. Further, even when the voltage range within which the back gate voltage of the MOS transistor is changed is varied, an optimum power supply voltage can be selected from a plurality of gamma voltages.

In one of preferred modes of the present invention, a reference voltage generation circuit (20) outputs first and the second reference voltage groups (20A, 20B) which respectively belonging to first and second voltage sections not overlapping each other. A decoder (10) receives the first and second reference voltage groups (20A, 20B) from the reference voltage generation circuit (20) and selects and outputs a reference voltage corresponding to a received digital signal (D1 to Dn). The decoder (10) includes a first sub-decoder (11) that receives the first reference voltage group (20A), a second sub-decoder (12) that receives the second reference voltage group, and a third sub-decoder (13) that receives a reference voltage selected by the second sub-decoder (12) and outputs the selected reference voltage to the first sub-decoder (11) or an output terminal (5) of the decoder. The first sub-decoder (11) comprises a plurality of switches each constituted by a first transistor (MP1) of a first conductivity type having a back gate supplied with a first power supply voltage (Vbp1). The second sub-decoder (12) comprises a plurality of switches each constituted by a second transistor (MP2) of the first conductivity type having a back gate supplied with a second power supply voltage (Vbp2) different from the first power supply voltage (Vbp1). The third sub-decoder (13) comprises at least one switch constituted by a third transistor (MP3) of the first conductivity type having a back gate supplied with the first power supply voltage (Vbp1).

In the present invention, the first power supply voltage (Vbp1) is a first reference voltage which is the voltage most spaced from the second voltage section among the first reference voltage group, or a predetermined voltage having the same magnitude relationship with the second voltage section as the first reference voltage (the predetermined voltage being on the same potential side as with the first voltage section against the second voltage section) and being more spaced from the second voltage section than the first reference voltage. The second power supply voltage (Vbp2) is a predetermined voltage within a range from a second reference voltage, which is a voltage closest to the first voltage section among the second reference voltage group, to a voltage within the first voltage section but not reaching the first reference voltage. In a mode of the present invention, the first conductivity type is P-type. The lower limit voltage of the first voltage section is higher in potential than the upper limit voltage of the second voltage section. The first power supply voltage (Vbp1) is set not less than the upper limit voltage of the first voltage section and not greater than a high-potential power supply voltage (VDD) of the decoder. The second power supply voltage (Vbp2) is set not less than the upper limit voltage of the second voltage section and less than the upper limit voltage of the first voltage section. Further, in another mode of the present invention, the first conductivity type is N-type; the upper limit voltage of the first voltage section is lower in potential than the lower limit voltage of the second voltage section, the first power supply voltage (Vbp1) is set not greater than the lower limit voltage of the first voltage section and not less than a low-potential power supply voltage of the decoder, and the second power supply voltage (Vbp2) is set not greater than the lower limit voltage of the second voltage section and greater than the lower limit voltage of the first voltage section.

Further, in modes of the present invention, an additional back gate power may be supplied by providing an amplifier circuit in a semiconductor device. Exemplary embodiments of the present invention will be described below.

Exemplary Embodiment 1

FIG. 1 is a diagram showing the configuration of an exemplary embodiment of the present invention. FIG. 1 shows a configuration example of a decoder including PMOS transistors as in FIG. 19. The decoder 10 selects one voltage from a plurality of reference voltages supplied by a reference voltage generation circuit 20 based on an n-bit input digital signal (where n is an integer greater than or equal to two) and outputs the selected voltage from a terminal 5. In FIG. 1, as the n-bit input digital signal, D1 to Dn and its complementary signal D1B to DnB are fed to the decoder 10. Here, a High level of the input digital signal is for instance a high-potential power supply voltage VDD, and a Low level is for instance a low-potential power supply voltage VSS. As shown in FIG. 1, the reference voltage generation circuit 20 divides a plurality of reference voltages generated based on a reference power supply voltage group 1 into the first reference voltage group 20A on high-potential side (belonging to a first voltage section) and the second reference voltage group 20B on low-potential side (belonging to a second voltage section that does not overlap the first voltage section), and outputs them to the decoder 10.

The decoder 10 comprises the first sub-decoder 11 that receives the first reference voltage group 20A on the high-potential side as input voltages, the second sub-decoder 12 that receives the second reference voltage group 20B on the low-potential side as input voltages, and the third sub-decoder 13 that receives at least an output of the second sub-decoder 12 as an input voltage. The first power supply voltage Vbp1 is supplied to back gates of PMOS transistors MP1 forming switches (pass transistors) constituting the first sub-decoder 11. The second power supply voltage Vbp2, different from the first power supply voltage Vbp1, is supplied to back gates of PMOS transistors MP2 forming switches (pass transistors) constituting the second sub-decoder 12. The first power supply voltage Vbp1 is supplied to a back gate of the PMOS transistor MP3 forming a switch (pass transistor) constituting the third sub-decoder 13. For the sake of simplicity, one PMOS transistor each is shown in the first to the third sub-decoders 11 to 13 in FIG. 1. The back gates of PMOS transistors constituting the switches (pass transistors) of the first and the third sub-decoders 11 and 13 are connected to the first back gate power supply Vbp1, and the back gates of the PMOS transistors constituting switches (pass transistors) in the second sub-decoder 12 are connected to the second back gate power supply Vbp2.

A node Nc, that is a connection node, at which an output of the third sub-decoder 13 and a node of the first sub-decoder 11 are connected, is controlled in such a manner that, when one of the first reference voltage group 20A and the second reference voltage group 20B is selected on the node Nc, the other is not selected.

A reference power supply voltage group 2 supplies the power supplies Vbp1 and Vbp2 to back gates of the PMOS transistors. Further, a voltage from the reference power supply voltage group 1 may be used as the back gate power supply voltage Vbp2. Vbp2 is set to a reference voltage having the highest potential among the second reference voltage group 20B (the upper limit voltage within the second voltage section), or a voltage which is greater than the upper limit voltage within the second voltage section and is less than a reference voltage having the highest potential among the first reference voltage group 20A (the upper limit voltage within the first voltage section). Vbp1 is set to a reference voltage having the highest potential among the first reference voltage group 20A (the upper limit voltage within the first voltage section), or a voltage which is greater than the upper limit voltage within the first voltage section and is less than or equal to the high-potential power supply voltage VDD.

According to the present exemplary embodiment, the range of voltage that can be outputted (the voltage range of the reference voltages generated by the reference voltage generation circuit 20) can be extended by supplying the power supply voltage Vbp2 to the back gate of the PMOS transistor MP2 in the second sub-decoder 12 thereby decreasing the threshold voltage thereof (in absolute value). Further, when the range of voltage that can be outputted is not to be widened, an increase in gate size (gate width) of the PMOS transistors in the second and the third sub-decoders 12 and 13 can be suppressed and an increase in area can be avoided.

Further, by supplying the power supply voltage Vbp1 (a reference voltage having the highest potential among the first reference voltage group 20A (the upper limit voltage within the first voltage section) or a voltage greater than this upper limit voltage) to the back gate of the PMOS transistor in the third sub-decoder 13, even if a reference voltage selected from the first reference voltage group 20A is applied to the connection node Nc, when a PMOS transistor having a P+ diffusion region (for instance a drain) connected to the connection node Nc in the third sub-decoder 13 is off, a leakage current will not flow from the $P^+$ diffusion region via a substrate to the back gate power supply of this PMOS transistor. It should be noted that three or more back gate power supply voltages can be used even though FIG. 1 shows a configuration example using only two power supply voltages Vbp1 and Vbp2 for supply to back gates of the PMOS transistors, only for facilitating the explanation. When a plurality of back gate power supply voltages are provided, it is necessary to consider that transistor regions should be isolated for each back gate power supply voltage. Specific examples described below also use two sorts of back gate power supply voltages.

Example 1

Figure 2:
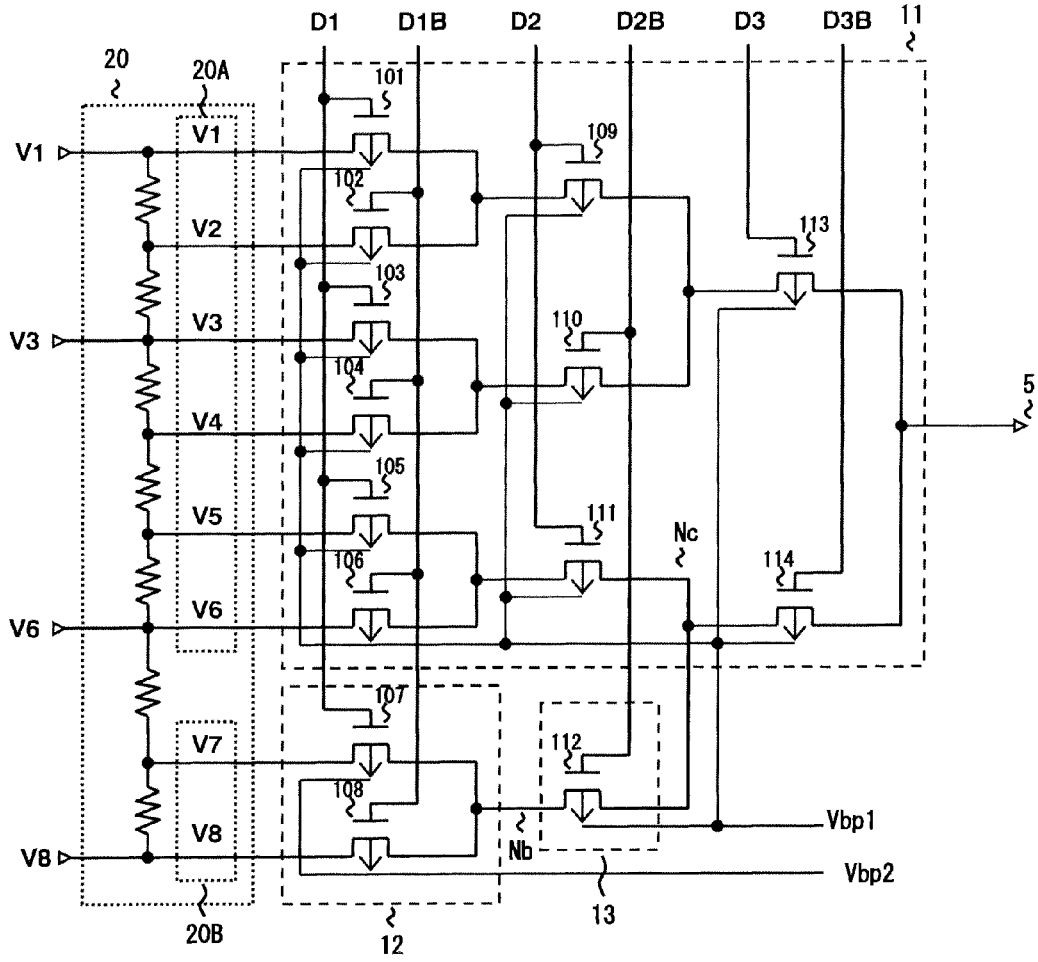
FIG. 2 is a diagram showing a configuration of a first example of the present invention.

FIG. 2 is a diagram showing the configuration of a first example of the present invention. FIG. 2 shows the configuration of the reference voltage generation circuit 20 and the decoder circuit 10 shown in FIG. 1. As shown in FIG. 2, the reference voltage generation circuit 20 receives V1, V3, V6, and V8 as the reference power supply voltage group 1, and outputs V1, V2, V3, V4, V5, and V6 as the first reference voltage group 20A on the high-potential side and V7 and V8 as the second reference voltage group 20B on the low-potential side from taps of voltage-divider resistors (ladder resistors) connected between V1 and V8.

The decoder 10, which receives a 3-bit digital signal (D1, D2, D3), where "n" in the n-bit digital signal in FIG. 1 is 3, and the complementary signal (D1B, D2B, D3B), selects a reference voltage from the eight reference voltages V1 to V8, and outputs the selected voltage, comprises the first to the third sub-decoder 11 to 13. The High level and Low level of each of the 3-bit digital signal (D1, D2, D3) and the complementary signal (D1B, D2B, D3B) is the high-potential power supply voltage VDD and the low-potential power supply voltage VSS, respectively.

The first sub-decoder 11 comprises

PMOS transistors 101, 103, and 105 having gates commonly supplied with D1 (LSB) and having first ends (P+ diffusion regions, for instance sources) supplied with the voltages V1, V3, and V5, respectively;

PMOS transistors 102, 104, and 106 having gates commonly supplied with D1B (the complementary signal to D1), and having first ends (for instance sources) supplied with the voltages V2, V4, and V6, respectively;

PMOS transistors 109 and 111 having gates commonly supplied with D2, and having first ends (P+ diffusion regions, for instance sources) connected to a connection node, at which second ends (for instance drains) of the PMOS transistors 101 and 102 are coupled, and to a connection node, at which second ends (for instance drains) of the PMOS transistors 105 and 106 are coupled, respectively;

a PMOS transistor 110 having a gate supplied with D2B, and having a first end (for instance a source) connected to a connection node at which second ends (for instance drains) of the PMOS transistors 103 and 104 are coupled;

a PMOS transistor 113 having a gate supplied with D3 (MSB), and having a first end (for instance a source) connected to a connection node at which second ends (for instance drains) of the PMOS transistors 109 and 110 are coupled; and a PMOS transistor 114 having a gate supplied with D3B, and having a first end (a P+ diffusion region, for instance a source) connected to a connection node (the node Nc) at which a second end (for instance a drain) of the PMOS transistor 111 and an output of the third sub-decoder 13 are connected.

The second sub-decoder 12 comprises a PMOS transistor 107 having a gate supplied with D1 (LSB), and having a first end (for instance a source) supplied with the voltage V7; and a PMOS transistor 108 having a gate supplied with D1B, and having a first end (for instance a source) supplied with the voltage V8 at a first end (for instance a source).

The third sub-decoder 13 comprises a PMOS transistor 112 having a gate supplied with D2B, and having a first end (for instance a source) connected to a connection node (an output node of the second sub-decoder 12) at which second ends (for instance drains) of the PMOS transistors 107 and 108 are coupled. A second end (for instance a drain) of the PMOS transistor 112 is connected to the second end (for instance the drain) of the PMOS transistor 111 in the first sub-decoder 11 and the node Nc and connected to the first end (for instance the source) of the PMOS transistor 114.

Back gates of the PMOS transistors 101 to 106, 109 to 111, 113, and 114 in the first sub-decoder 11 are connected in common to the first back gate power supply Vbp1.

Back gates of the PMOS transistors 107 and 108 in the second sub-decoder 12 are connected in common to the second back gate power supply Vbp2.

A back gate of the PMOS transistor 112 in the third sub-decoder 13 is connected in common to the first back gate power supply Vbp1.

Further, the relations between the first and the second back gate power supplies Vbp1 and Vbp2 are as shown in (6) and (7).

$$Vbp1 \geqq V1 > V2 > V3 > \ldots > V8 \quad (6)$$

$$VDD \geqq Vbp1 \geqq V1 > Vbp2 \geqq V7 > V8 \geqq VSS \quad (7)$$

In other words, the power supply Vbp2 having a potential lower than that of Vbp1 is supplied to the back gates of the PMOS transistors 107 and 108 that select V7 and V8 constituting the second reference voltage group 20B on the low-potential side.

Vbp1 is supplied to the back gates of the PMOS transistors 101 to 106, 109 to 111, 113, and 114 in the first sub-decoder 11 that select V1 to V6 constituting the first reference voltage group 20A on the high-potential side, and to the back gate of the PMOS transistor 112 in the third sub-decoder 13 that receives the output of the second sub-decoder 12.

The connection node Nc, at which the output of the second sub-decoder 12 and the first sub-decoder 11 are connected, is controlled in such a manner that, when one of the first reference voltage group 20A and the second reference voltage group 20B is selected, the other is not selected. More specifically, a voltage selected from one of the first reference voltage group 20A and the second reference voltage group 20B is transferred through one of the PMOS transistor 111 and the PMOS transistor 112, which is turned on, to the connection node Nc.

In the configuration of FIG. 2, when D1, which is the LSB (the Least Significant Bit), is at a Low level (D1B=High), the P-channel transistors 101, 103, 105, and 107 having gates supplied with D1 are turned on (made electrically conductive), the P-channel transistors 102, 104, 106, and 108 having gates supplied with D1B are turned off (made electrically nonconductive), the reference voltages V1, V3, V5, and V7 are transferred to one ends (for instance sources) of the P-channel transistors 109, 110, 111, and 112, respectively. When D1B is at a Low level (D1=High), the P-channel transistors 102, 104, 106, and 108 are turned on, the P-channel transistors 101, 103, 105, and 107 are turned off, and the reference voltages V2, V4, V6, and V8 are transferred to one ends (for instance sources) of the P-channel transistors 109, 110, 111, and 112, respectively.

When D2 is at a Low level (D2B=High), the P-channel transistors 109 and 111 having gates supplied with D2 are turned on, the P-channel transistors 110 and 112 having gates supplied with D2B are turned off, and the voltage V1 or V2 passing through the P-channel transistor 101 or 102 and the voltage V5 or V6 passing through the P-channel transistor 105 or 106 are transferred to one ends (for instance sources) of the P-channel transistors 113 and 114 respectively. When D2B is at a Low level (D2=High), the P-channel transistors 110 and 112 are turned on, the P-channel transistors 109 and 111 are turned off, and the voltage V3 or V4 passing through the P-channel transistor 103 or 104 and the voltage V7 or V8 passing through the P-channel transistor 107 or 108 are transferred to one ends (for instance sources) of the P-channel transistors 113 and 114, respectively.

When D3 is at a Low level (D3B=High), the P-channel transistor 113 having a gate supplied with D3 are turned on, the P-channel transistor 114 having a gate supplied with D3B is turned off, and a voltage (any one of the voltages V1 to V4) passing through the P-channel transistor 109 or 110 is transferred to the terminal 5. When D3B is at a Low level (D3=High), the P-channel transistor 114 is turned on, the P-channel transistor 113 is turned off, and a voltage (any one of the voltages V5 to V8) passing through the P-channel transistor 111 or 112 is transferred to the terminal 5 (the output terminal of the decoder).

In FIG. 2, the PMOS transistor 111 in the first sub-decoder 11 and the PMOS transistor 112 in the second sub-decoder 12 are controlled by complementary signals D2 and D2B, respectively, and when one of the transistors 111 and 112 is turned on, the other is turned off.

The voltages of the back gates of the PMOS transistors 107 and 108 in the second sub-decoder 12 that receives V7 and V8 constituting the second reference voltage group 20B on the low-potential side are lower than the high-potential power supply voltage VDD, and by supplying the back gate power supply Vbp2 (≧V7>V8) greater than or equal to the voltages applied to the sources, the threshold voltages |Vtp| (in absolute values) of the PMOS transistors 107 and 108 are reduced from the threshold voltages in a case where the high-potential power supply voltage VDD is supplied to the back gates thereof.

As a result, when the reference voltage V7 or V8 is selected, the PMOS transistor 107 or 108 having gates supplied with the Low level (VSS) are turned on (electrically conductive), since the gate-to-source voltage $|V_{GS}|$ of each of the PMOS transistor 107 and 108 is greater than the threshold voltage |Vtp|, and the range of voltage that can be outputted is widened. Further, since the threshold voltages |Vtp| (in absolute value) of the PMOS transistor 107 and 108 decrease, an increase in a propagation delay thereof can be avoided. When such a delay that is approximately the same as that in a case where the threshold voltage |Vtp| (in absolute value) of the PMOS transistor is high is allowed, an area can be reduced by reducing the gate width W. Further, Vbp1 is greater than or equal to the reference voltage V1 and less than or equal to the power supply voltage VDD.

Further, when D2 is at a Low level (D2B is at a High level), the PMOS transistor 111 are turned on and the reference voltage V5 or V6 is selected and outputted to the node Nc. The back gate voltage of the PMOS transistor 112 having a P+ diffusion region (the drain) connected to the node Nc is Vbp1, and since $$Vbp1 \geqq V1 > V5 > V6,$$

a leakage current does not flow from the P+ diffusion region (the drain) of the PMOS transistor 112 into the hack gate power supply Vbp1 or the substrate.

Further, since the relations among the voltage Vbp2 at the back gates of the PMOS transistors 107 and 108 having V7 and V8 applied to P+ diffusion regions thereof, V7, and V8 are as follows:

$$Vbp2 \geqq V7 > V8,$$

a leakage current does not flow from the P+ diffusion regions (drains) into the back gate power supply Vbp2 or the substrate.

The above description is made using the configuration example of the 3-bit decoder shown in FIG. 2. In a decoder of 4 bits or more, although the number of the reference voltages selected by the second sub-decoder 12 and the number of the PMOS transistors in the second sub-decoder 12 increase, the third sub-decoder 13 can still be constituted by one PMOS transistor having a gate supplied with a bit signal lower by one bit than the MSB signal or a complementary signal of the bit signal. Therefore, in the present example, the effect that the area of the decoder can be reduced by decreasing the gate widths W of the PMOS transistors in the second sub-decoder 12 is significant.

Example 2

Figure 3:
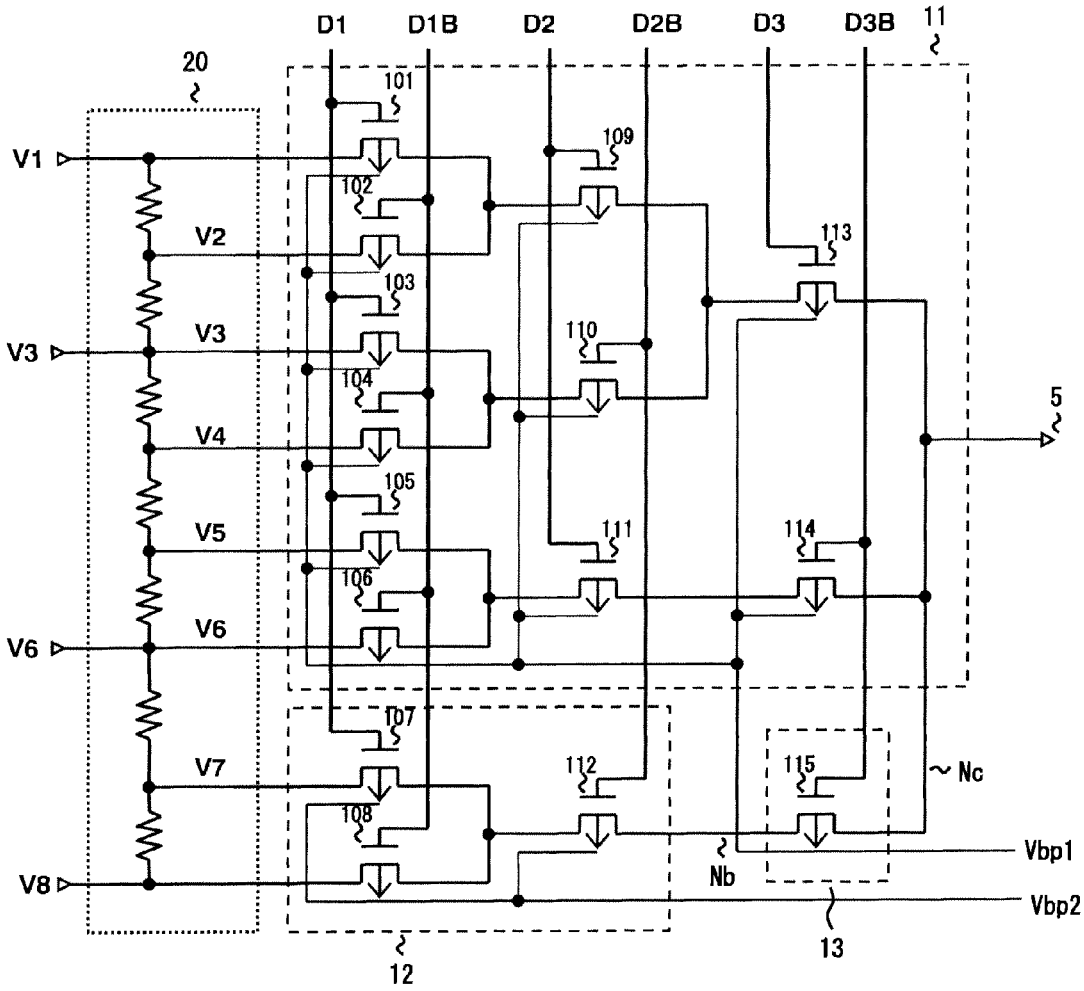
FIG. 3 is a diagram showing a configuration of a second example of the present invention.

FIG. 3 is a diagram showing the configuration of a second example of the present invention. As a concrete example of FIG. 1, FIG. 3 shows a configuration different from that of FIG. 2. With reference to FIG. 3, the PMOS transistor 112 in FIG. 2 is included in the second sub-decoder 12, the second back gate power supply Vbp2 is supplied to the back gate of the PMOS transistor 112, a PMOS transistor 115 having a first end (for instance a source) supplied with the output of the second sub-decoder 12, having a gate supplied with D3B, and having a second end (for instance a drain) connected in common to the terminal 5 with second ends (for instance drains) of the PMOS transistors 113 and 114 is provided as the third sub-decoder 13; and the first back gate power supply Vbp1 is supplied in common to a back gate of the PMOS transistor 115 and to the back gates of the PMOS transistors in the first sub-decoder 11 in the present example.

As in the previous example in FIG. 2, the first back gate power supply Vbp1 satisfies the following relation (8).

$$Vbp1 \geqq V1 > V2 > V3 > \ldots > V8 \quad (8)$$

The second back gate power supply Vbp2 satisfies the following magnitude relationship (9).

$$VDD \geqq Vbp1 \geqq V1 > Vbp2 \geqq V5 > V6 > V7 > V8 \geqq VSS \quad (9)$$

When D3 is at a Low level, the PMOS transistor 113 is turned on, and the PMOS transistor 114 is turned off. Since the voltage Vbp1 at the back gate of the PMOS transistor 115 is greater than or equal to the maximum reference voltage V1 appearing at the node Nc via the PMOS transistor 113 in an ON state, a leakage current does not flow from the drain (P+ diffusion region) of the PMOS transistor 115 into the back gate power supply and the substrate even when V1 is outputted to the node Nc.

When D3B is at a Low level, the PMOS transistors 114 and 115 are turned on. At this time, when D2 is at a Low level, the PMOS transistor 111 are turned on, the PMOS transistor 112 is turned off, and the reference voltage V5 or V6 appears at the node Nc via the PMOS transistors 111 and 114 in the ON state. The reference voltage V5 or V6 outputted to the node Nc appears at a node Nb via the PMOS transistor 115 in the ON state and is applied to the second end (P+ diffusion region: drain) of the PMOS transistor 112. However, since the voltage Vbp2 at the back gate of the PMOS transistor 112 is greater than or equal to V5, a leakage current does not flow from the drain (P+ diffusion region) of the PMOS transistor 112 into the back gate power supply and the substrate even when the reference voltage V5 or V6 is applied to the node Nb.

Further, in FIG. 3, the back gate power supply Vbp2 (≧V5) supplied to the back gates of the PMOS transistors 107, 108, and 112 in the second sub-decoder 12 has a potential higher than the back gate power supply Vbp2 (≧V7) in FIG. 2. Because of this, the threshold voltages (in absolute values) of the PMOS transistors 107, 108, and 112 in the second sub-decoder 12 in FIG. 3 do not drop as much as the threshold voltages (in absolute values) of the PMOS transistors 107 and 108 in the second sub-decoder 12 in FIG. 2. However, whereas the number of the PMOS transistors connected in series from the output node Nb of the second sub-decoder 12 to the output terminal 5 of the decoder 10 and receiving the back gate power supply Vbp1 is two (the PMOS transistors 112 and 114) in the configuration shown in FIG. 2, the configuration in FIG. 3 requires only one (the PMOS transistor 115). Therefore, an on-resistance when the voltage V7 or V8 is selected and outputted to the output terminal 5 of the decoder 10 can be reduced in the configuration in FIG. 3 as in Example 1 shown in FIG. 2. As a result, the range of voltage that can be outputted is widened in the present example shown in FIG. 3 as in Example 1 in FIG. 2. Or it is also possible to reduce the area by decreasing the gate widths W of the PMOS transistors 107, 108, and 112 in the second sub-decoder 12. In a configuration of a multi-bit decoder, the third sub-decoder 13 may be constituted by one PMOS transistor having a gate supplied with D3 (MSB) signal or a complementary signal thereof.

Exemplary Embodiment 2

Figure 4:
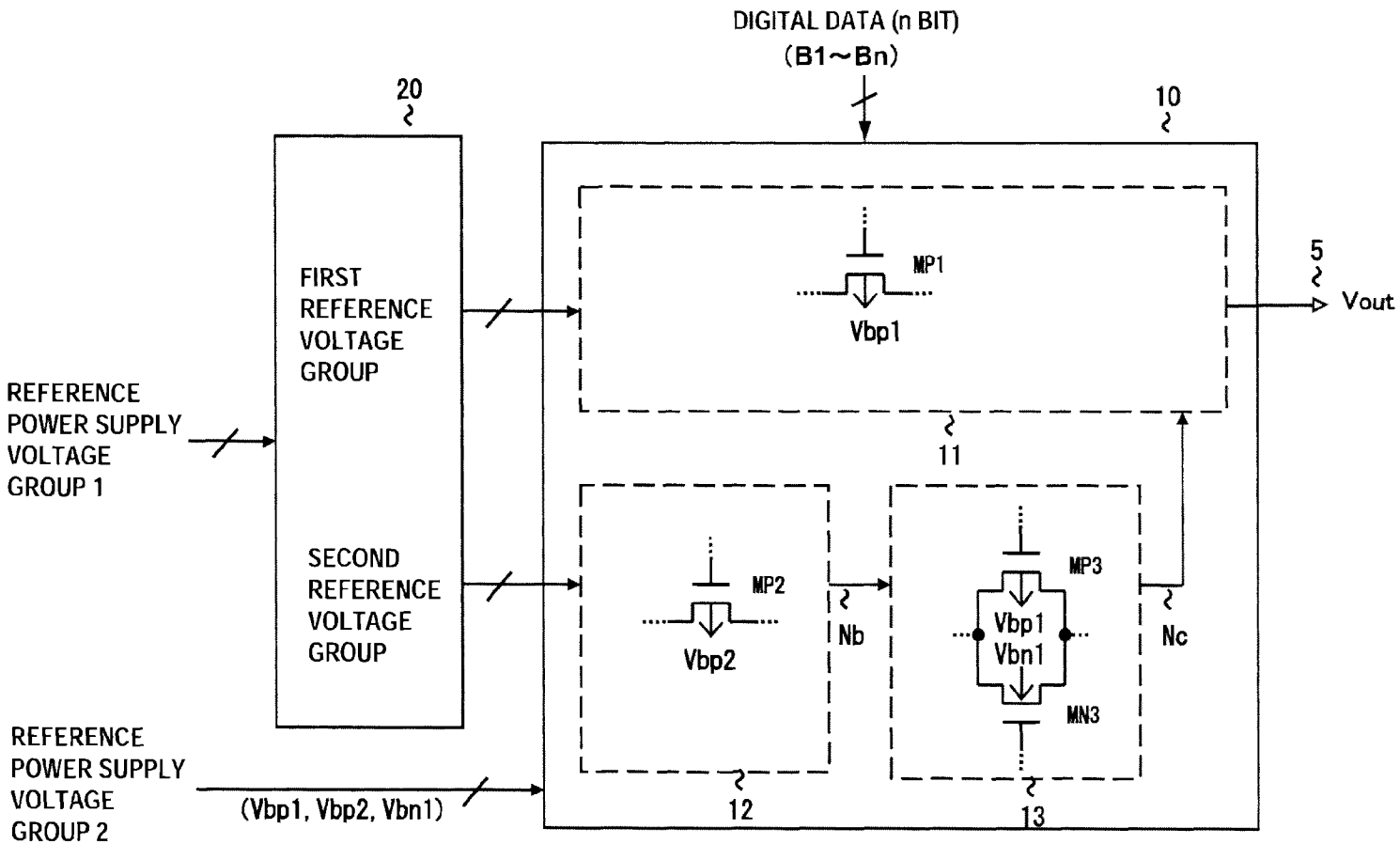
FIG. 4 is a diagram showing a configuration of a second exemplary embodiment of the present invention.

FIG. 4 is a diagram showing the configuration of a second exemplary embodiment of the present invention. With reference to FIG. 4, the switch in the third sub-decoder 13 is constituted by a CMOS transfer gate in the present exemplary embodiment. According to the present exemplary embodiment, an on-resistance decreases because of the CMOS configuration constituted by a PMOS transistor MP3 and an NMOS transistor MN3 in the third sub-decoder 13. The on-resistance of the switch of the CMOS transfer gate is a parallel combined resistance of an on-resistance of the PMOS transistor MP3 and an on-resistance of the NMOS transistor MN3 and is smaller than the on-resistance of the sole PMOS transistor MP3. Since the first back gate power supply Vbp1 is supplied to the back gate of the PMOS transistor MP3 of the CMOS transfer gate, the lower limit voltage that the switch (pass transistor) can transfer is restricted. However, by adding the NMOS transistor MN3, and adding a voltage range that can be transferred by the NMOS transistor switch MN3, the lower limit voltage that can be transferred by the CMOS switch (transfer gate) can be lowered. A third back gate power supply Vbn1 is supplied to a back gate of the NMOS transistor MN3. Vbp1, Vbp2, and Vbn1 are supplied from the reference power supply voltage group 2. It should be noted that at least one of Vbp1, Vbp2, and Vbn1 may be supplied from the reference power supply voltage group 1. According to the present exemplary embodiment, it is possible to widen the range of voltage that can be outputted, as compared with Exemplary Embodiment 1 shown in FIG. 1. Further, it is possible to reduce the area by decreasing the gate width W of each PMOS transistor MP2 in the second sub-decoder 12, due to the fact that the on-resistance of the switch in the third sub-decoder 13 is reduced by having the switch in a CMOS configuration.

Example 3

Figure 5:
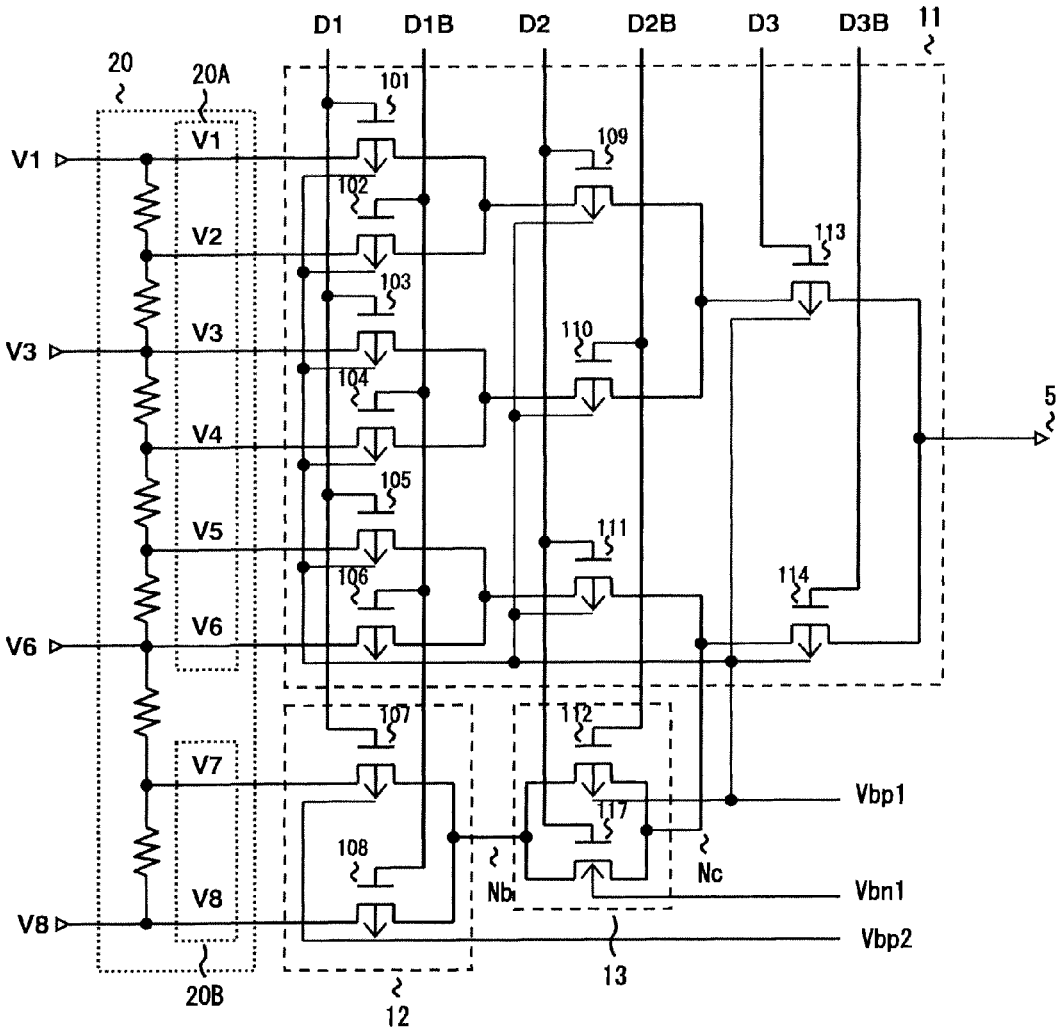
FIG. 5 is a diagram showing a configuration of a third example of the present invention.

FIG. 5 is a diagram showing the configuration of a third example. As a concrete example of FIG. 4, FIG. 5 shows configuration examples of the reference voltage generation circuit 20 and the decoder circuit 10 in FIG. 4. With reference to FIG. 5, in the present example, in the third sub-decoder 13, an NMOS transistor 117 is added to the configuration in FIG. 2. The NMOS transistor 117 has its source and drain connected to the drain and the source of the PMOS transistor 112, respectively, in the third sub-decoder 13, has a gate supplied with D2, and has a back gate supplied with the third back gate power supply Vbn1. The first back gate power supply Vbp1, the second back gate Vbp2, and the third back gate power supply Vbn1 satisfy the following relation.

$$Vbp1 \geqq V1 > V2 > V3 > \ldots > V8 \quad (10)$$

$$VDD \geqq Vbp1 \geqq V1 > Vbp2 \geqq V7 > V8 \geqq Vbn1 \geqq VSS \quad (11)$$

When D2 is at a Low level (D2B is at a High level), the PMOS transistor 111 are turned on and the reference voltage V5 or V6 is selected and transferred to the node Nc. Since a voltage at the back gate of the PMOS transistor 112 having its P+ diffusion region connected to the node Nc is Vbp1 and $$Vbp1 \geqq V1 > V5 > V6,$$

a leakage current does not flow from the P+ diffusion region (the drain) of the PMOS transistor 112 into the back gate power supply Vbp1 or a substrate. Since a voltage at the back gate of the NMOS transistor 117 constituting the CMOS transfer gate with the PMOS transistor 112 is Vbn1 and $$Vbn1 \geqq V8,$$

a leakage current, an issue with the PMOS transistors, does not flow from a P+ diffusion region into the substrate in the NMOS transistor 117.

Since the relations among the voltage Vbp2 at the back gates of the PMOS transistors 107 and 108 having P+ diffusion regions thereof applied with V7 and V8, where $$Vbp2 \geqq V7 > V8,$$

a leakage current does not flow from the P+ diffusion regions into the back gate power supply Vbp2 or the substrate.

When D2 is at a High level and D2B is at a Low level, the PMOS transistor 112 and the NMOS transistor 117 in the third sub-decoder 13 are both turned on, and the on-resistance of the third sub-decoder 13 decreases more than in the configuration shown in FIG. 2. Further, the NMOS transistor 117 in the ON state widens the range of voltage that the third sub-decoder 13 can output (i.e., the lower limit voltage that can be outputted is lowered). Further, as described in Exemplary Embodiment 2 shown in FIG. 4, due to the fact that the switch in the third sub-decoder 13 has a CMOS configuration using the PMOS transistor 112 and the NMOS transistor 117, and the on-resistance of the CMOS switch is decreased as compared to a single PMOS transistor, the area can be reduced by decreasing the gate width W of each PMOS transistor in the second sub-decoder 12.

In FIG. 5, there is shown an example of the configuration of a 3-bit decoder. In a configuration of a multi-bit decoder, although the number of the reference voltages selected by the second sub-decoder 12 and the number of the PMOS transistors in the second sub-decoder 12 increase, the third sub-decoder 13 can still be constituted by one CMOS switch controlled to be turned on and off by a bit signal lower by one bit than the MSB signal and a complementary signal of the bit signal. The effect of decreasing a gate width W of each PMOS transistor in the second sub-decoder 12 is significantly contributing to the reduction of an area of the decoder.

Example 4

Figure 6:
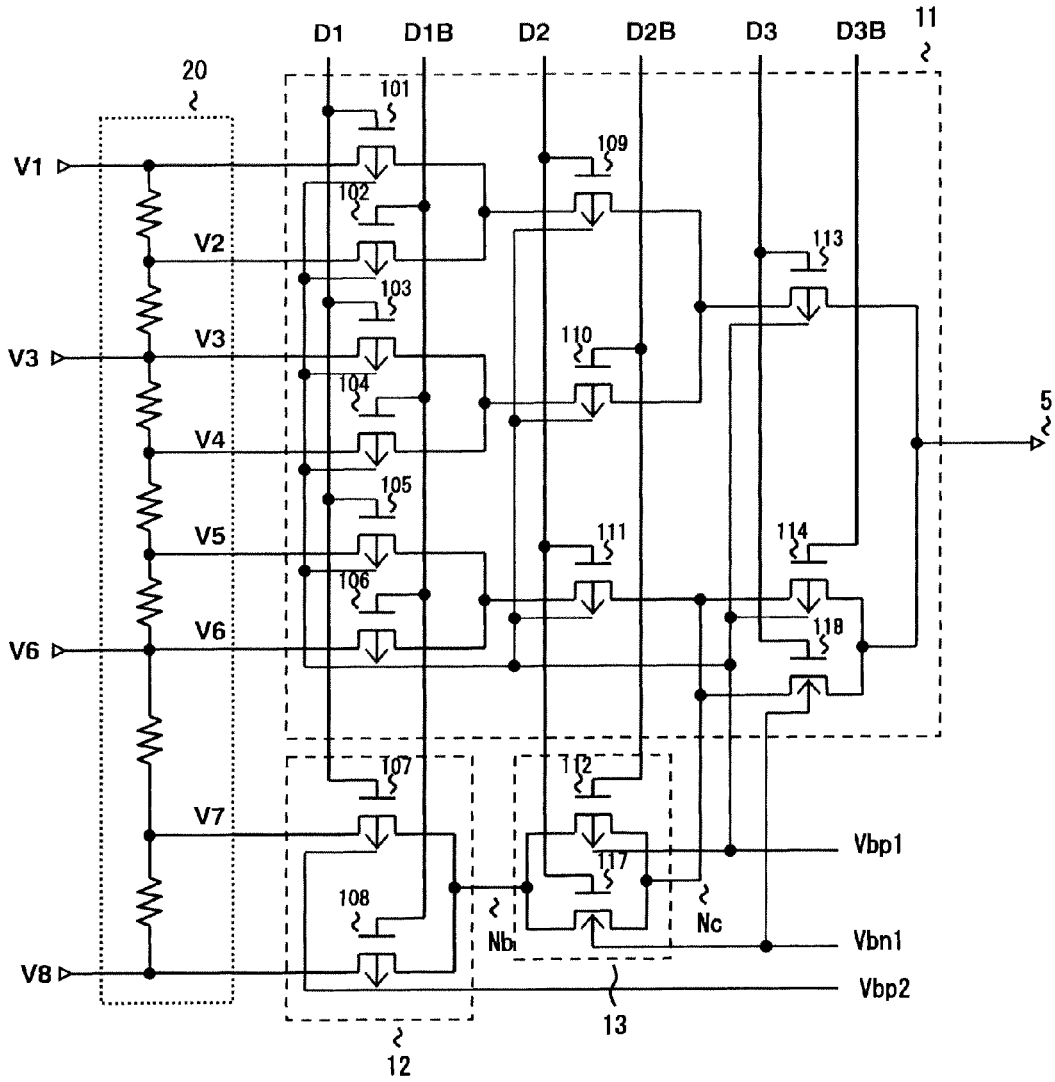
FIG. 6 is a diagram showing a configuration of a fourth example of the present invention.

FIG. 6 is a diagram showing the configuration of a fourth example of the present invention. With reference to FIG. 6, the present example is a modification of the configuration shown in FIG. 5. In addition to the configuration in FIG. 5, there is provided an NMOS transistor 118 having a drain and a source connected respectively to a source and a drain of the PMOS transistor 114 in the first sub-decoder 11, having a gate supplied with D3 (MSB), and having a back gate supplied with Vbn1.

When D3 is at a High level and D3B is at a Low level, the PMOS transistor 114 and the NMOS transistor 118 in the first sub-decoder 11 both are turned on, and the on-resistance is reduced more than in the configuration shown in FIG. 5. Further, the NMOS transistor 118 in an ON state widens the range of voltage that can be transferred to the terminal 5 (i.e., the lower limit voltage that can be outputted is lowered). Further, the area can be reduced by decreasing the gate width W of each PMOS transistor in the second sub-decoder 12.

Example 5

Figure 7:
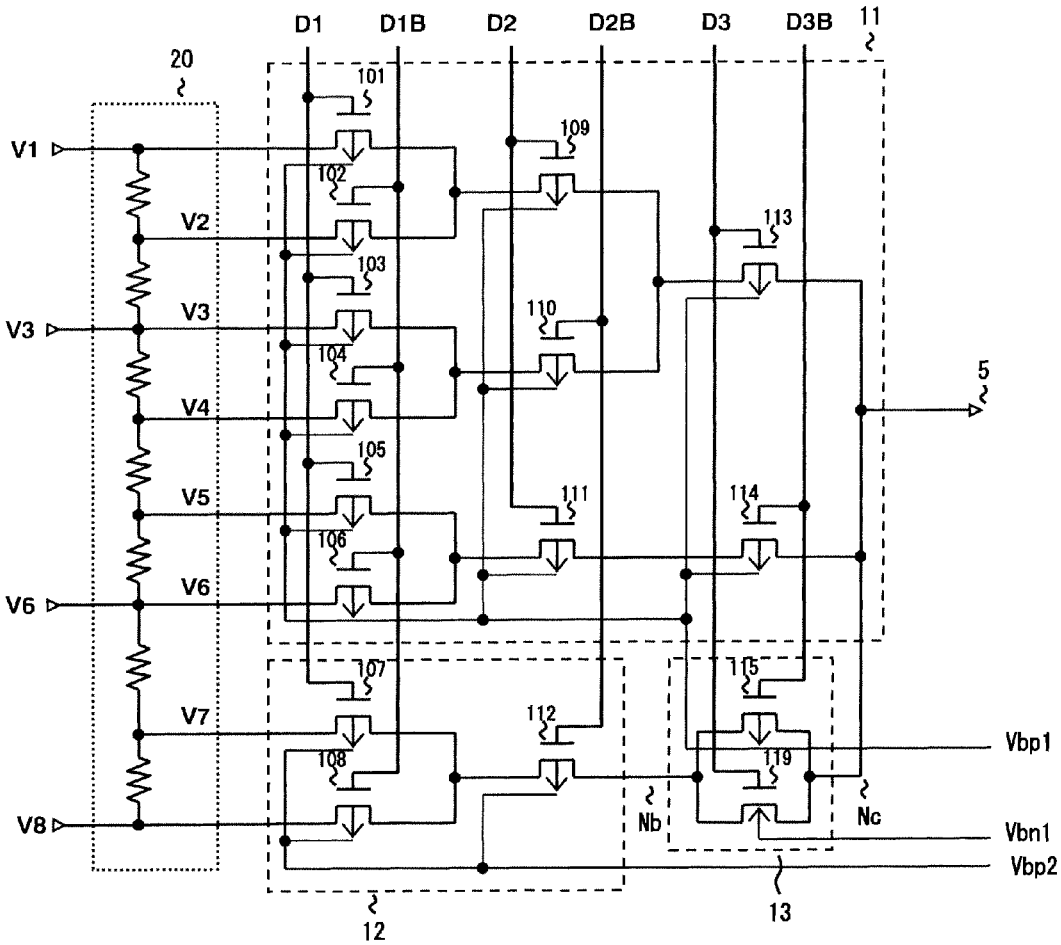
FIG. 7 is a diagram showing a configuration of a fifth example of the present invention.

FIG. 7 is a diagram showing the configuration of a fifth example of the present invention. As another example of FIG. 4, FIG. 7 shows a configuration in which an NMOS transistor 119 is connected to the PMOS transistor 115 in the third sub-decoder 13 in the configuration in FIG. 3. The NMOS transistor 119 has a source and a drain connected to a drain and a source of the PMOS transistor 115, has a gate connected to D3 (MSB), and has a back gate connected to the third back gate power supply Vbn1.

The first back gate power supply Vbp1, the second back gate power supply Vbp2, and the third back gate power supply Vbn1 satisfy the following relations.

$$Vbp1 \geqq V1 > V2 > V3 > \ldots > V8 \quad (12)$$

$$VDD \geqq Vbp1 \geqq V1 > Vbp2 \geqq V5 > V6 > V7 > V8 \geqq Vbn1 \geqq VSS \quad (13)$$

When D3 is at a High level and D3B is at a Low level, the PMOS transistor 115 and the NMOS transistor 119 in the third sub-decoder 13 both are turned on, the on-resistance is reduced more than in the configuration shown in FIG. 3, and the range of voltage that can be outputted is widened even more.

When D3 is at a Low level, the PMOS transistor 113 are turned on, and the PMOS transistors 114 and 115, and the NMOS transistor 119 all are turned off. Since the voltage Vbp1 at the back gate of the PMOS transistor 115 is greater than or equal to the maximum reference voltage V1 appearing at the node Nc via the PMOS transistor 113 in the ON state, a leakage current does not flow from the drain (P+ diffusion region) of the PMOS transistor 115 into the back gate power supply Vbp1 and the substrate, even when V1 is outputted to the node Nc. Further, since a voltage at the back gate of the NMOS transistor 119 is Vbn1 and $$Vbn1 \geqq V8,$$

a leakage current, which is an issue with the PMOS transistor configuration, does not flow from the node Nc into the NMOS transistor 119.

When D3B is at a Low level, the PMOS transistor 113 is turned off, and the PMOS transistors 114 and 115 and the NMOS transistor 119 are turned on. At this time, when D2 is at a Low level, the PMOS transistor 111 is turned on, the PMOS transistor 112 is turned off, and the reference voltage V5 or V6 appears at the node Nc via the PMOS transistors 111 and 114 which are in an ON state. The reference voltage V5 or V6 outputted to the node Nc appears at the node Nb via the PMOS transistor 115 and the NMOS transistor 119 in an ON state and is applied to the second end (P+ diffusion region) of the PMOS transistor 112. However, since the voltage Vbp2 at the back gate of the PMOS transistor 112 is greater than or equal to V5, a leakage current does not flow from the P+ diffusion region of the PMOS transistor 112 into the substrate, even when the reference voltage V5 or V6 is applied to the node Nb.

Further, the back gate power supply Vbp2 (≧V5) supplied to the back gates of the PMOS transistors 107, 108, and 112 in the second sub-decoder 12 in the configuration of FIG. 7 has a potential higher than that of the power supply Vbp2 (≧V7) supplied to the back gates of the PMOS transistors 107 and 108 in the second sub-decoder 12 in FIG. 5. Because of this, the threshold voltages (in absolute values) of the PMOS transistors 107, 108, and 112 in the second sub-decoder 12 in FIG. 7 do not drop as much as the threshold voltages (in absolute values) of the PMOS transistors 107 and 108 in the second sub-decoder 12 in FIG. 5.

However, in the present example shown in FIG. 7, the number of the PMOS transistors connected in series from the output node Nb of the second sub-decoder 12 to the output terminal 5 of the decoder 10 and supplied with the back gate power supply Vbp1 can be reduced. As a result, the on-resistance when the voltage V7 or V8 is selected and outputted to the output terminal 5 of the decoder 10 can be reduced in the present example in FIG. 7 as in Example 3 shown in FIG. 5. Therefore, the range of voltage that can be outputted is widened in the present example shown in FIG. 7 as in Example 3 in FIG. 5. Or it is also possible to reduce the area by decreasing the gate width W of each PMOS transistor in the second sub-decoder 12 in the present example shown in FIG. 7 as in Example 3 in FIG. 5. In a configuration of a multi-bit decoder, the third sub-decoder 13 can still be constituted by one CMOS switch controlled to be turned on and off by the MSB signal and a complementary signal of the MSB signal.

Comparative Example

Figure 8:
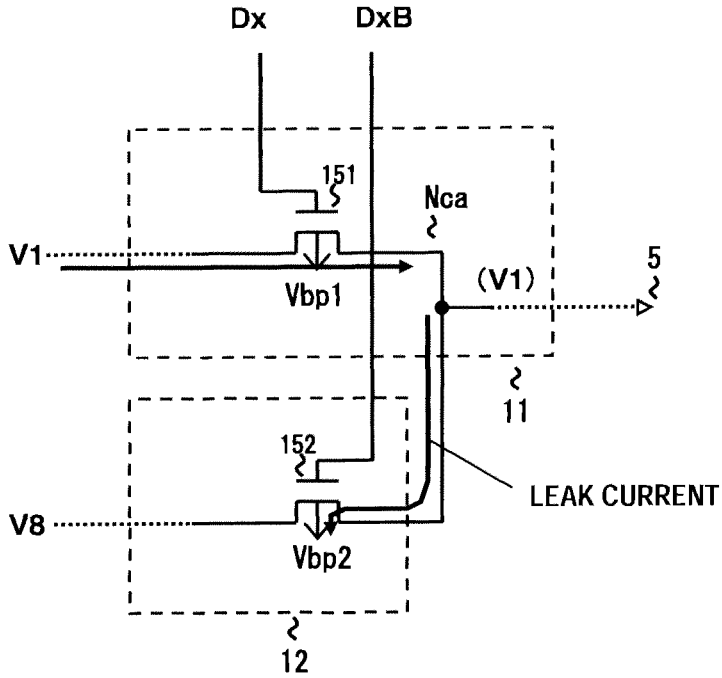
FIG. 8 is a diagram for explaining a comparative example.

FIG. 8 is a diagram for explaining effects in a case where no third sub-decoder 13 is provided in FIGS. 1 and 2 as a comparative example.

The first sub-decoder 11 is able to select the maximum reference voltage V1 from the reference voltages, and the first back gate power supply Vbp1 is supplied to a back gate of a PMOS transistor 151. The second sub-decoder 12 is able to select the minimum reference voltage V8 from the reference voltages, and the second hack gate power supply Vbp2 is supplied to a back gate of a PMOS transistor 152.

The following relation holds in FIG. 8.

$$VDD \geqq Vbp1 \geqq V1 > Vbp2 > V8 \geqq VSS \quad (14)$$

The output of the second sub-decoder 12 is directly connected to the first sub-decoder 11 by a connection node Nca. Due to the fact that the power supply Vbp2 is supplied to the back gate of the PMOS transistor 152 in the second sub-decoder 12, the PMOS transistor 152 is able to select the reference voltage V8, which cannot be selected in a case where the power supply Vbp1 is supplied to the back gate thereof. Because of a decrease in a source-to-substrate voltage, the threshold voltage |Vtp| (in absolute value) drops. In a case where V8=VSS+α (α>0), a source-to-gate voltage is |α|, when a gate voltage of the PMOS transistor 152 is at a Low level (VSS), and a channel is formed on the surface of the substrate and directly below the gate electrode, turning the transistor on, when the gate voltage is greater than or equal to the threshold voltage |Vtp|.

When a digital signal Dx (x=1 to n) is at a Low level (DxB is at a High level), and the PMOS transistor 151 in the first sub-decoder 11 are turned on and selects the reference voltage V1, the PMOS transistor 152 that transfers V8 to the terminal 5 in the second sub-decoder 12 is in an OFF state. At this time, in the configuration shown in FIG. 8, when the PMOS transistor 152 in the second sub-decoder 12 is in an OFF state, a leakage current flows from the node Nca into the back gate power supply Vbp2 in the second sub-decoder 12. As a result, the reference voltage V1 selected by the first sub-decoder 11 cannot be outputted accurately. Further, the leakage current may damage elements. A PMOS transistor formed on a silicon substrate is formed in an N-well region in a case of a P-type silicon substrate, and drain/source diffusion regions are formed by P+ diffusion regions (P+).

When V1, the power supply Vbp2, and GND are applied to the drain diffusion region (the node Nca), the back gate (N-well region) and the P-type substrate, respectively, of the PMOS transistor 152 and the potential relations are as follows:

$$V1>Vbp2>GND,$$

a leakage current flows since a forward bias is applied to a PNP junction formed by the drain diffusion region, the back gate, and the silicon substrate of the PMOS transistor 152.

In order to prevent this, it is necessary to insert a PMOS transistor having a back gate applied with Vbp1 (corresponding to the PMOS transistor in the sub-decoder 13 in the present example) between the output of the second sub-decoder 12 and the first sub-decoder 11.

Figure 9:
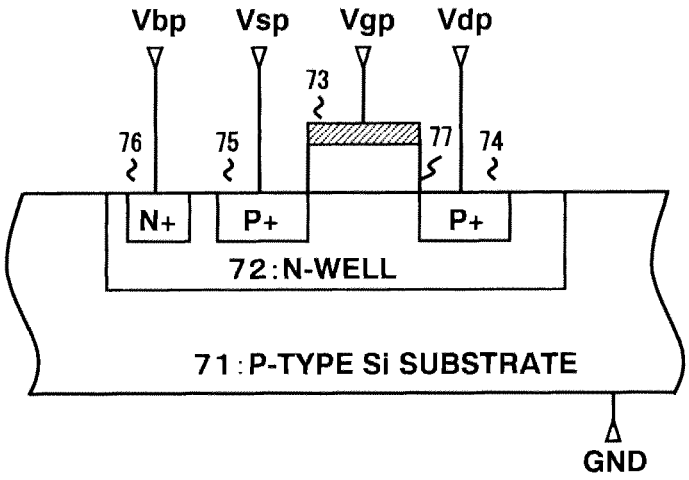
FIG. 9 is a diagram for explaining a PMOS transistor.

FIG. 9 is a diagram showing an outline of the configuration of a PMOS transistor. In FIG. 9, 71 denotes a P-type silicon substrate; 72 an N-well; 73 a gate electrode; 74 a drain (P+ diffusion region); 75 a source (P+ diffusion region); 76 an N-well contact (N+ diffusion region); and 77 a gate oxide film. Vgp denotes a gate voltage; Vsp a source voltage; Vdp a drain voltage; and Vbp a back gate voltage. When the potential relations are:

$$Vdp>Vbp>GND,$$

a leakage current flows since a forward bias is applied to a PNP junction formed by the drain 74, the N-well 72, and the P-type silicon substrate 71.

The leakage current in FIG. 8 that flows when the PMOS transistor 152 is in an OFF state corresponds to that in FIG. 9 as Vgp=DxB (High), Vgp=V8, Vdp=V1, Vbp=Vbp2, and GND=VSS and $$Vdp(=V1)>Vbp(=Vbp2)>GND(=VSS).$$

Figure 10A:
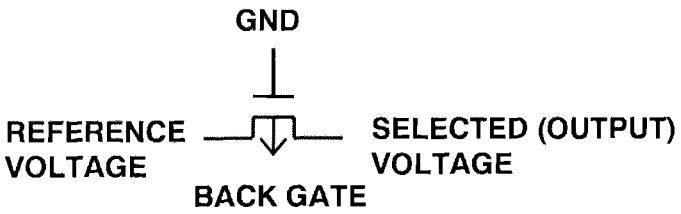
FIGS. 10A and 10B are diagrams for explaining a selected voltage and the on-resistance of a PMOS transistor.
Figure 10B:
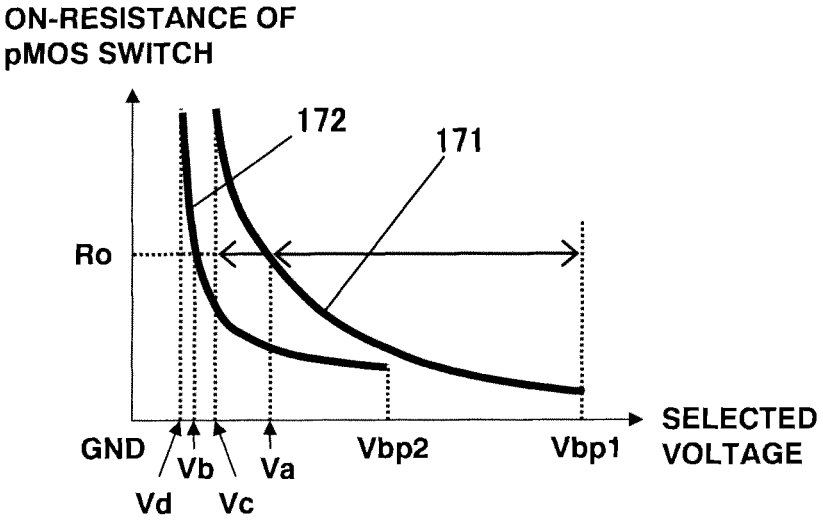

FIGS. 10A and 10B are diagrams for explaining the present invention. FIG. 10A is a diagram for explaining a PMOS transistor (pass transistor) functioning as a switch. When a gate voltage is at a GND potential, a reference voltage is outputted as a selected voltage (output voltage). FIG. 10B is a diagram for explaining the relation between the on-resistance of a PMOS transistor switch of a reference-dimension and the selected voltage. 171 denotes an on-resistance characteristic of a PMOS transistor having a back gate applied with Vbp1, and 172 denotes an on-resistance characteristic of a PMOS transistor having a back gate applied with Vbp2. Ro is an allowable maximum value of an on-resistance of the PMOS transistor, with an output delay of the selected voltage taken into account.

Figure 19:
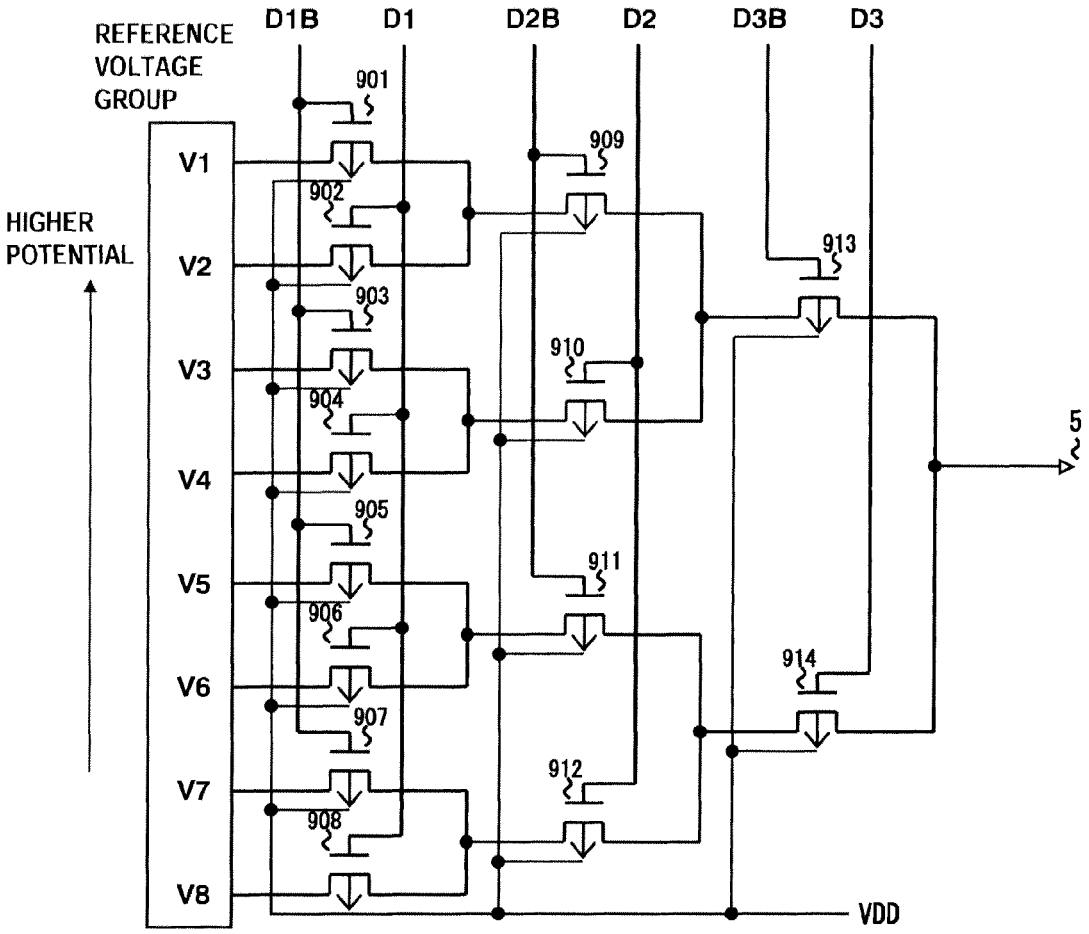
FIG. 19 RELATED ART
FIG. 19 is a diagram for explaining a typical configuration example of a decoder.
Figure 20:
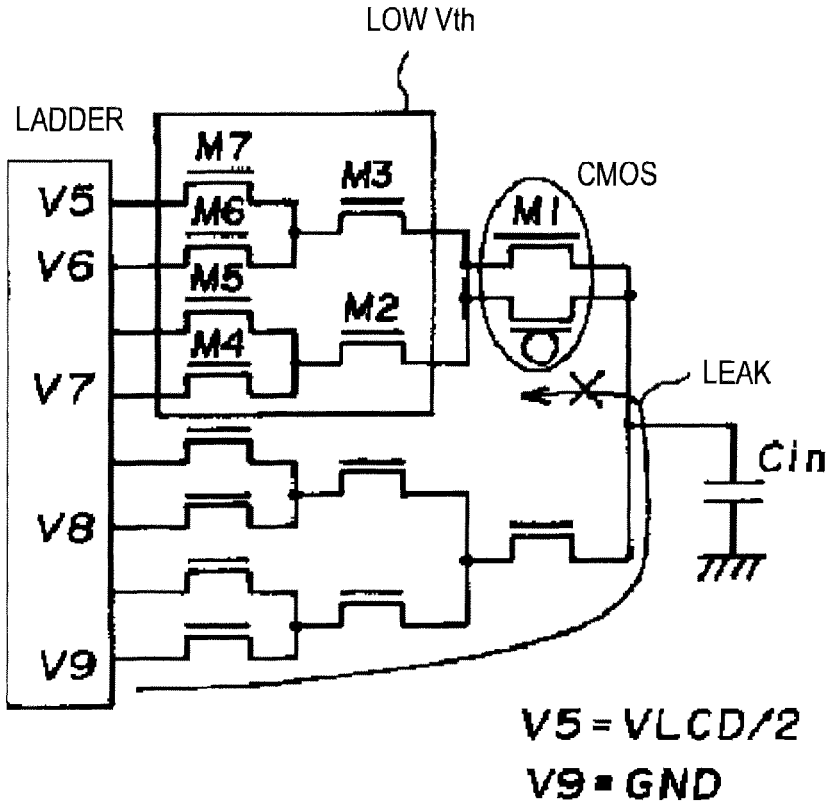
FIG. 20 RELATED ART
FIG. 20 is a diagram showing a configuration of Patent Document 1.

In the case of the circuit of the related technology shown in FIG. 19, the high-potential power supply VDD is supplied to the back gates of all the PMOS transistors, which have the on-resistance characteristic 171 in FIG. 10B, and the allowable range of voltage that the PMOS transistor is able to select and output is from Vc to Vbp1. In a case where the circuit is operated within a predetermined selection period which is determined with an output delay of the selected voltage taken into account, an operating voltage range is from an x-coordinate Va, where the characteristic curve 171 and Ro meets, to Vbp1. In order to widen the operating voltage range, the gate widths of PMOS transistors which select a voltage between Vc and Va must be increased from the reference dimension.

In the present exemplary embodiments and examples (for instance FIGS. 1 to 3) described above, by supplying the power supply Vbp2 to the back gates of the PMOS transistors selecting and outputting the reference voltages on the low voltage side, the range of voltage that the decoder 10 is able to select can be widened to a range from Vc to Vbp1. The operating voltage range of the decoder 10 in a case where the decoder 10 is operated within a predetermined selection period determined with the output delay of the selected voltage taken into account is also from Vc to Vbp1. Further, it is possible to set the voltage range of the PMOS transistors in the second sub-decoder 12 having back gates supplied with Vbp2 to less than or equal to Vc. However, since the output (the node Nb) of the second sub-decoder 12 is outputted to the output terminal 5 of the decoder 10 via the PMOS transistor (having a back gate supplied with Vbp1) in the third sub-decoder 13, the selected voltage range and the operating voltage range are restricted by the voltage range of the PMOS transistor having a back gate supplied with Vbp1.

Further, whereas the on-resistance of the PMOS transistor in the third sub-decoder 13 that transfers voltages between Vc and Va exceeds Ro, the on-resistances of the PMOS transistors in the second sub-decoder 12 that transfers voltages between Vc and Va are less than Ro. Because of this, the average on-resistance of the PMOS transistors contributing the transfer of the selected signal (the reference voltage) can be made less than or equal to Ro. As a result, an increase in the gate widths W of the PMOS transistors in the second and the third sub-decoders 12 and 13 can be suppressed. When the switch in the third sub-decoder 13 has a CMOS configuration (FIGS. 4 to 7), an on-resistance of a CMOS switch is lower than the characteristic 171 shown in FIG. 10B and, since the minimum value of the allowable voltage range is decreased to a value lower than Vc shown in FIG. 10B, it is possible to widen the selected voltage range or make PMOS transistors in the second sub-decoder 12 smaller than a reference dimension.

In FIG. 2, when the selected voltages V7 and V8 correspond to Vc to Va in FIG. 10B, the back gate voltage of the PMOS transistors 114 and 112 in the first and the third sub-decoders 11 and 13 is Vbp1. The on-resistance characteristic of the PMOS transistors 114 and 112 is given by the characteristic 171 in FIG. 10B and exceeds Ro. However, the back gate voltage of the PMOS transistors 107 and 108 in the second sub-decoder 12 is Vbp2, and the on-resistance characteristic which is given by the characteristics 172 in FIG. 10B, is less than Ro. The selection operation of the decoder will not have any issue as long as an on-resistance mean value per a transistor derived from combined on-resistances of the PMOS transistors 112 and 114, and the PMOS transistor 107 or 108 is not greater than Ro. In this case, each of the PMOS transistors 112, 114, 107 and 108 can have a reference dimension and is able to select the reference voltages V7 and V8.

In FIG. 7, in case the reference voltages V7 and V8 correspond to Vc to Va in FIG. 10B, the on-resistance characteristic of the CMOS switch (including the PMOS transistor 115 and the NMOS transistor 119) in the third sub-decoder 13 is lower than the characteristic 171 in FIG. 10B and less than Ro.

Further, the back gates of the PMOS transistors 107, 108, and 112 in the second sub-decoder 12 are supplied in common with Vbp2, and the on-resistance characteristic is given by the characteristics 172 in FIG. 10B and is less than Ro. As a result, each of the PMOS transistors 107, 108, 112 and 115 can be of a reference dimension or smaller. Alternatively, it is also possible to extend the lower limit of the selected voltages V7 and V8 to a voltage lower than Vc shown in FIG. 10B.

Figure 11:
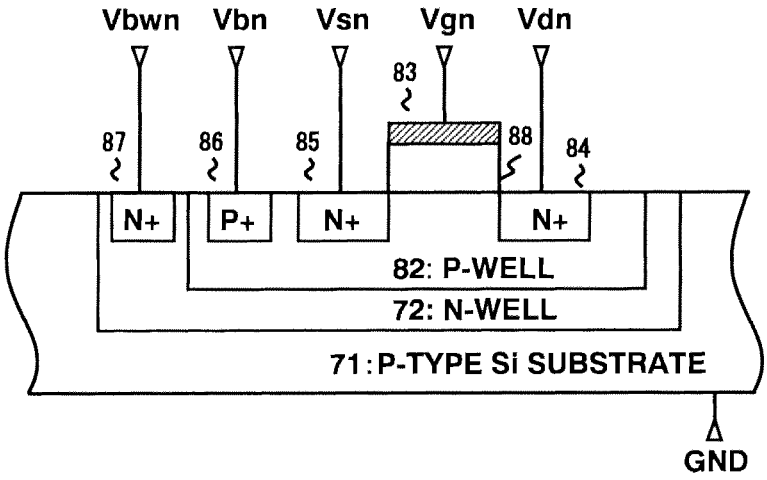
FIG. 11 is a diagram for explaining an NMOS transistor.

FIG. 11 is a diagram showing an outline of the configuration of an NMOS transistor in which a back gate voltage can be controlled. In FIG. 11, 71 denotes a P-type silicon substrate; 72 an N-well; 82 a P-well; 83 a gate electrode; 84 a drain (N+ diffusion region); 85 a source (N+ diffusion region); 86 a P-well contact (P+ diffusion region); 87 an N-well contact (N+ diffusion region); and 88 a gate oxide film. Vgn denotes a gate voltage; Vsn a source voltage; Vdn a drain voltage; Vbn a back gate voltage; and Vbwn an N-well voltage. In a configuration in which the two wells, the N-well 72 and the P-well 82, overlap, the back gate voltage Vbn of the NMOS transistor can be variable as well. When the potential relations are as follows:

$$Vdn<Vbn<Vbwn,$$

a leakage current flows since a forward bias is applied to a NPN junction formed by the drain 84, the P-well 82, and the N-well 72.

Exemplary Embodiment 3

Figure 12:
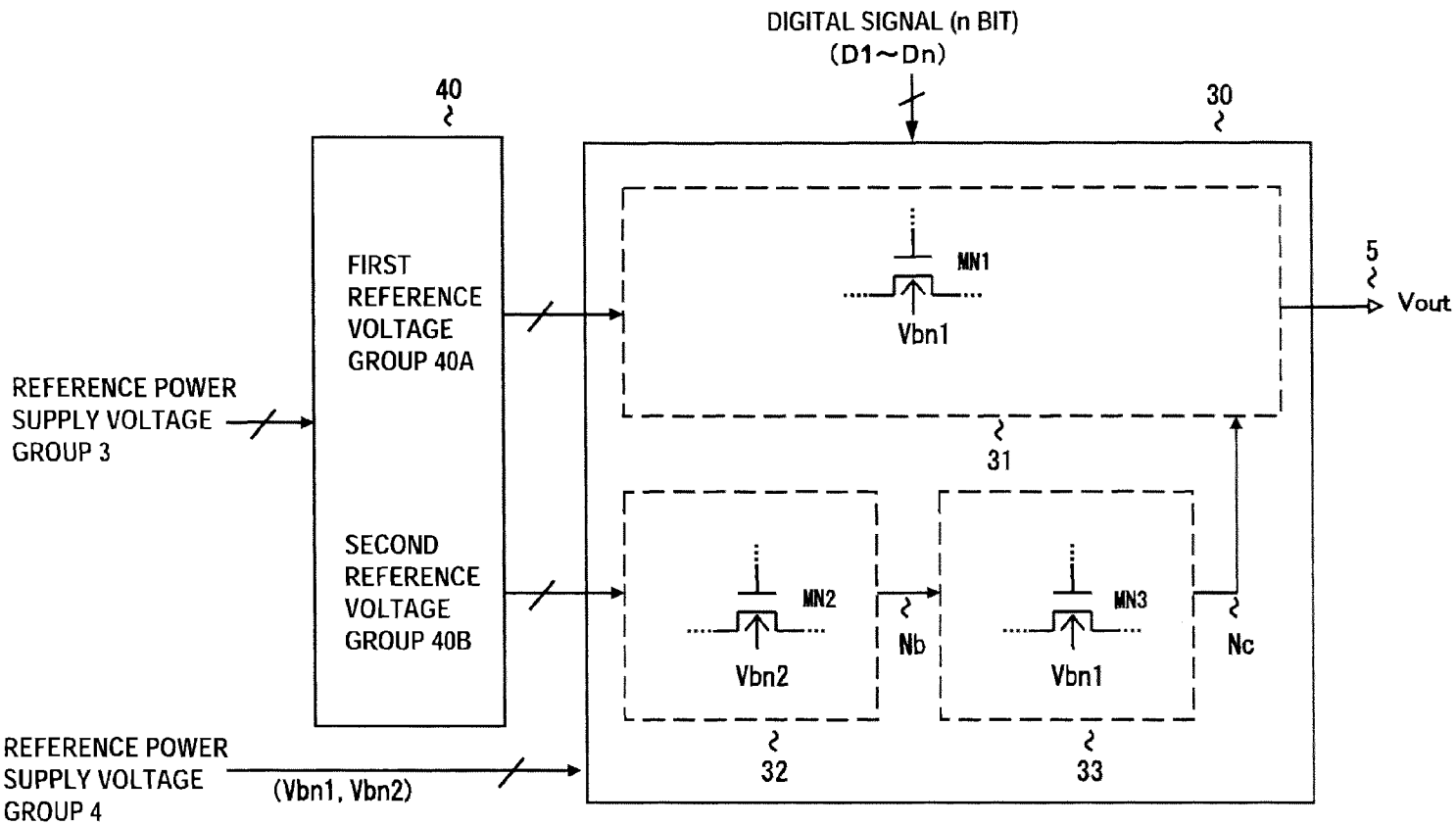
FIG. 12 is a diagram showing a configuration of a third exemplary embodiment of the present invention.

FIG. 12 is a diagram showing the configuration of a third exemplary embodiment of the present invention. In the present exemplary embodiment, the decoder 10 constituted by the PMOS transistors in the exemplary embodiment 1 shown in FIG. 1 is replaced with a decoder 30 constituted by NMOS transistors (refer to FIG. 11). In FIG. 12, the decoder 30 comprises first to third sub-decoders 31 to 33. The third back gate power supply Vbn1 is supplied to back gates of NMOS transistors MN1 and MN3 in the first and the third sub-decoders 31 and 33. A fourth back gate power supply Vbn2 is supplied to a back gate of an NMOS transistor MN2 in the second sub-decoder 32.

A reference voltage generation circuit 40 divides a plurality of reference voltages generated based on a reference power supply voltage group 3 into a high-potential side and a low-potential side, and outputs first and second reference voltage groups 40A and 40B, which constitute the high-potential side and the low-potential side.

In the present example, the first reference voltage group 40A include reference voltages on the low-potential side, i.e., the low-potential power supply VSS side, and the second reference voltage group 40B include reference voltages on the high-potential side, i.e., the high-potential power supply VDD side. The voltage range (first voltage section) of the first reference voltage group 40A and the voltage range (second voltage section) of the second reference voltage group 40B do not overlap.

The third back gate power supply Vbn1 is supplied to the back gate of each switch (NMOS transistor MN1) in the first sub-decoder 31 selecting the first reference voltage group 40A on the low-potential side, and the fourth back gate power supply Vbn2, different from the third back gate power supply Vbn1, is supplied to the back gate of each switch (NMOS transistor MN2) in the second sub-decoder 32 selecting the second reference voltage group 40B on the high-potential side. Vbn1 is supplied to the back gate of the switch (NMOS transistor MN3) in the third sub-decoder 33 receiving an output of the second sub-decoder 32. The connection node Nc, at which an output of the third sub-decoder 33 and a node of the first sub-decoder 31 are connected, is controlled in such a manner that, when either the first reference voltage group 40A or the second reference voltage group 40B is selected, the other is unselected. The reference power supply voltage group 4 is a power supply which is supplied to the back gates.

Vbn2 is a reference voltage having the lowest potential among the second reference voltage group 40B (the lower limit voltage of the second voltage section), or a voltage lower than the lower limit voltage of the second voltage section, and is set to a voltage higher than a reference voltage having the lowest potential among the first reference voltage group 40A (the lower limit voltage of the first voltage section). Vbn2 may use the voltage of the reference power supply voltage group 3.

Vbn1 is a reference voltage having the lowest potential among the first reference voltage group 40A (the lower limit voltage of the first voltage section), or a voltage lower than the lower limit voltage of the first voltage section, and is set to a voltage greater than or equal to the low-potential power supply voltage VSS.

According to the present exemplary embodiment, by supplying the power supply Vbn2 to the back gate of the switch (NMOS transistor MN2) in the second sub-decoder 32, the threshold voltage Vtn of switch (NMOS transistor MN2) is decreased and the range of voltage that can be outputted is widened. Alternatively, when the range of voltage that can be outputted is maintained, an increase in the area can be prevented by restraining an increase in the gate size (the gate width) of the NMOS transistors in the second and the third sub-decoders 32 and 33.

Further, even if a reference voltage selected from the first reference voltage group 40A is applied to the connection node Nc, when the NMOS transistor in the third sub-decoder 33 having its N+ diffusion region (for instance a drain) connected to the connection node Nc is in an OFF state, by supplying the power supply Vbn1 to the back gate of the NMOS transistor in the third sub-decoder 33, a leakage current will not flow between the N+ diffusion region (drain) 84 and the N-well 72 of the NMOS transistor. It should be noted that three or more back gate power supply voltages can be used even though FIG. 12 shows an example using only two power supply voltages Vbn1 and Vbn2 for the back gates of the NMOS transistors, in order to simplify the explanation.

Exemplary Embodiment 4

Figure 13:
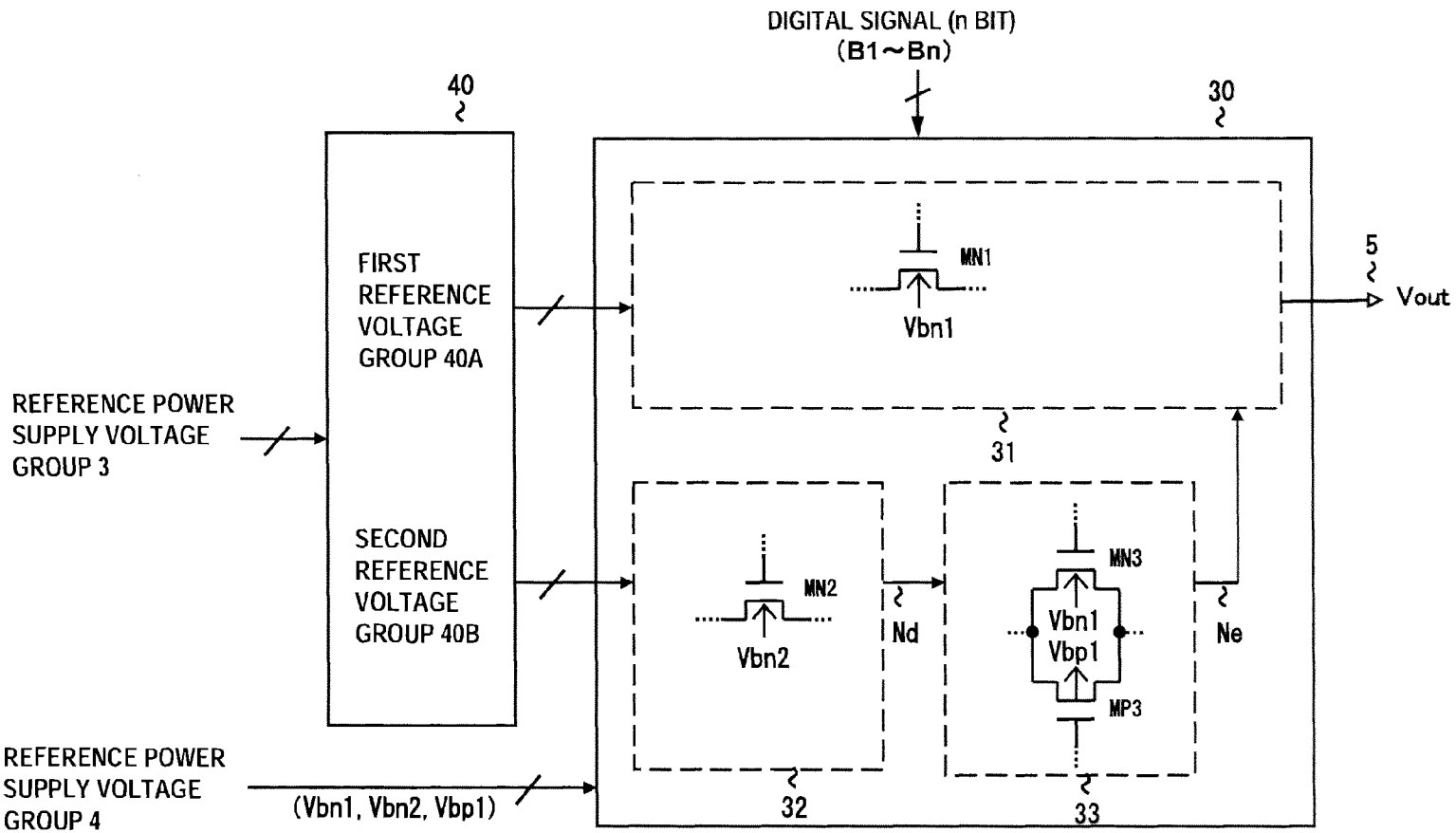
FIG. 13 is a diagram showing a configuration of a fourth exemplary embodiment of the present invention.

FIG. 13 is a diagram for explaining a fourth exemplary embodiment of the present invention. In the present exemplary embodiment, NMOS transistors are used in the configuration shown in FIG. 4, and the switch (NMOS transistor MN3) in the third sub-decoder 33 in FIG. 12 is composed as a CMOS transfer gate. The back gate voltage of the PMOS transistor MP3 of the CMOS transfer gate is Vbp1 (for instance VDD). A back gate voltage of the switches (NMOS transistors MN1, MN3) in the first and the third sub-decoders 31 and 33 is Vbn1, and a back gate voltage of the switch (NMOS transistor MN2) in the second sub-decoder 32 is Vbn2.

According to the present exemplary embodiment, by configuring the switch in the third sub-decoder 33 as a CMOS transfer gate constituted by the PMOS transistor MP3 and the NMOS transistor NM3, it becomes possible to widen the range of voltage that can be outputted, compared to the configuration shown in FIG. 12. Further, it is possible to reduce the area by decreasing a gate width W of each NMOS transistor in the second sub-decoder 32 due to the fact that an on-resistance in the third sub-decoder 33 is reduced.

[Output Range of an LCD Driver]

Figure 14A:
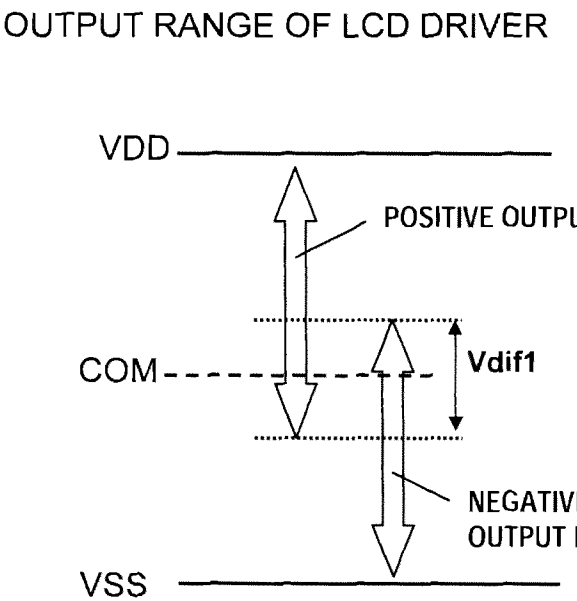
FIGS. 14A and 14B are diagrams for explaining the present invention.

FIG. 14A schematically shows an example of an output range of an LCD (Liquid Crystal Device) driver. An LCD driver performs positive/negative polarity inversion drive on a common electrode voltage COM. A positive voltage range and a negative voltage range are separated into a high-potential side and a low-potential side respectively. However, when an adjustment range Vdif1 of the common electrode voltage is taken into account, a range wider than 0.5×VDD is required to be outputted from each voltage range.

[Output Range of an OLED Driver]

Figure 14B:
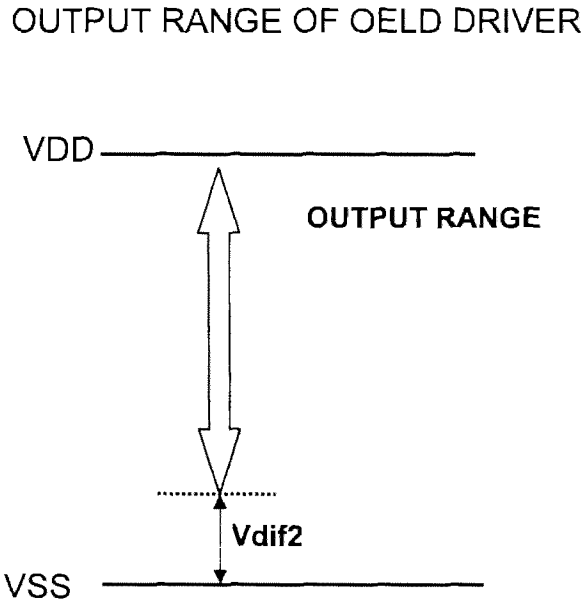

FIG. 14B schematically shows an example of an output range of an active matrix (voltage program type) OLED (Organic Electro-Luminescent Display) driver. Unlike the LCD driver, an OLED driver does not perform polarity inversion drive. In an example of FIG. 14B, the output range is from (VSS+Vdif2) to VDD. A potential difference Vdif2 is a potential difference between electrodes required for an organic EL element formed on a display panel to emit light, or is caused by the threshold voltage of a transistor on the display panel controlling a current supplied to the organic EL element.

In both FIGS. 14A and 14B, a wide output range is required between the power supply voltages VDD and VSS. Therefore, in each driver, a decoder selecting a level voltage corresponding to the output voltage is also required to have a wide output voltage range.

A decoder constituted by PMOS transistors (switches) can easily select voltages on the high-potential side using the PMOS transistors, however, there are cases where the PMOS transistors selecting a reference voltage on the low-potential side cannot output the selected reference voltage on the low-potential side because of a rapid increase in an on-resistance Ron (refer to the expression (5)) caused by an increase in the threshold voltage |Vtp| (in absolute value) due to a substrate bias effect and a decrease in the gate-to-source voltage $|V_{GS}|$.

Further, a decoder constituted by NMOS transistors (switches) can easily select voltages on the low-potential side using the NMOS transistors, however, there are cases where the NMOS transistors selecting a reference voltage on the high-potential side cannot output the selected reference voltage on the high-potential side because of a rapid increase in an on-resistance Ron (refer to the expression (5)) caused by an increase in the threshold voltage Vtn due to a substrate bias effect and a decrease in the gate-to-source voltage $V_{GS}$.

In order to suppress the increase in the on-resistance Ron of a switch transistor, the gate width W of the switch transistor must be widened, or the switch must have a CMOS configuration (including a PMOS transistor and an NMOS transistor connected in parallel). As a result, the area of the decoder increases greatly. By applying the present invention, the increase in the area of the decoder can be prevented, and the area can be reduced, as compared with the conventional configuration (FIG. 19).

The examples described with reference to FIGS. 1 to 7 are decoder configurations suitable for the positive output range in FIG. 14A and the output range in FIG. 14B. The examples described with reference to FIGS. 12 and 13 are decoder configurations suitable for the negative output range in FIG. 14A.

Exemplary Embodiment 5

Figure 15:
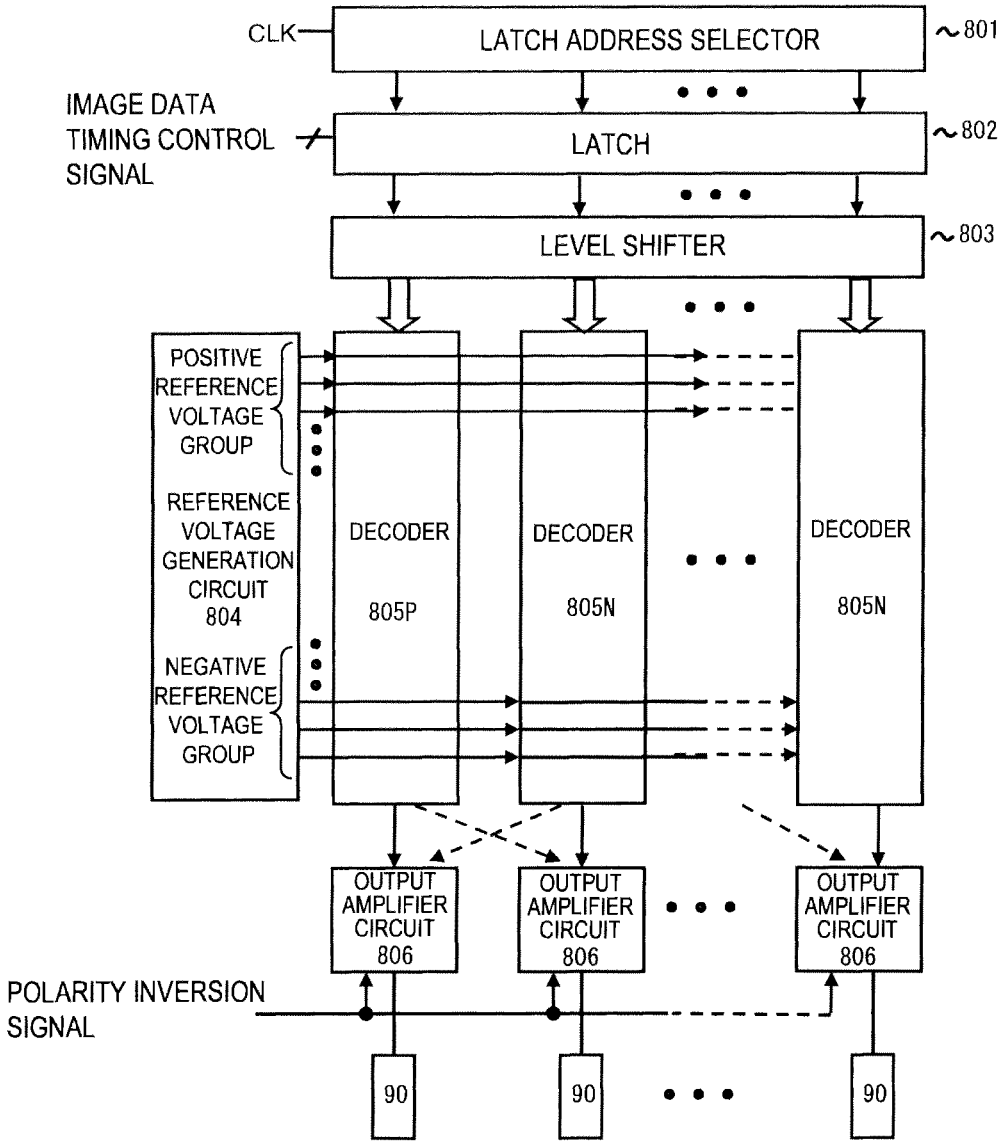
FIG. 15 is a diagram for explaining the configuration of a data driver of a fifth exemplary embodiment of the present invention.

FIG. 15 is a diagram showing the configuration of a fifth exemplary embodiment of the present invention. In the present exemplary embodiment, the decoder described above is applied to a data driver for a liquid crystal display device. In FIG. 15, main parts of the data driver according to the present exemplary embodiment are shown in a form of a block diagram.

With reference to FIG. 15, the data driver includes a latch address selector 801, a latch 802, a level shifter 803, a reference voltage generation circuit 804, positive decoders 805P, negative decoders 805N, output amplifier circuits 806, a control signal generation circuit (not shown in FIG. 15), and loads (data lines) 90 driven by the output amplifier circuits 806. The decoders 805P and 805N are constituted by the examples described above. Or the positive decoder 805P may be constituted by the PMOS transistors shown in FIGS. 1 to 7, and the negative decoder 805N may be constituted by the NMOS transistors shown in FIGS. 12 and 13.

The latch address selector 801 determines a data latch timing based on a clock signal CLK. The latch 802 latches image digital data based on the timing determined by the latch address selector 801 and outputs the data en bloc to the decoders (the positive decoder 805P, the negative decoder 805N) via the level shifter 803 in response to the timing of a timing control signal. The latch address selector 801 and the latch 802 are logic circuits and generally operate at a low voltage (0V to 3.3V).

The reference voltage generation circuit 804 generates a positive reference voltage group and a negative reference voltage group. The positive decoder 805P receives the positive reference voltage group, selects a reference voltage corresponding to the received data, and outputs the selected voltage as a positive signal voltage. The negative decoder 805N receives the negative reference voltage group, selects a reference voltage corresponding to the received data, and outputs the selected voltage as a negative signal voltage.

Each output amplifier circuit 806 receives the reference voltage outputted from each positive decoder 805P and each negative decoder 805N, and AC drives the load (data line) 90 with positive and negative voltages according to a supplied polarity inversion signal.

Since neighboring data lines of a liquid crystal display device have different voltage polarities, the positive signal voltage and the negative signal voltage from the positive decoder 805P and the negative decoder 805N are either outputted in a straight-connected manner or cross-connected manner to two output amplifier circuits 806 driving neighboring loads (data lines) 90 based on a polarity signal. The polarity signal is generated by the control signal generation circuit along with a control signal for the output amplifier circuit 806.

Exemplary Embodiment 6

Figure 16:
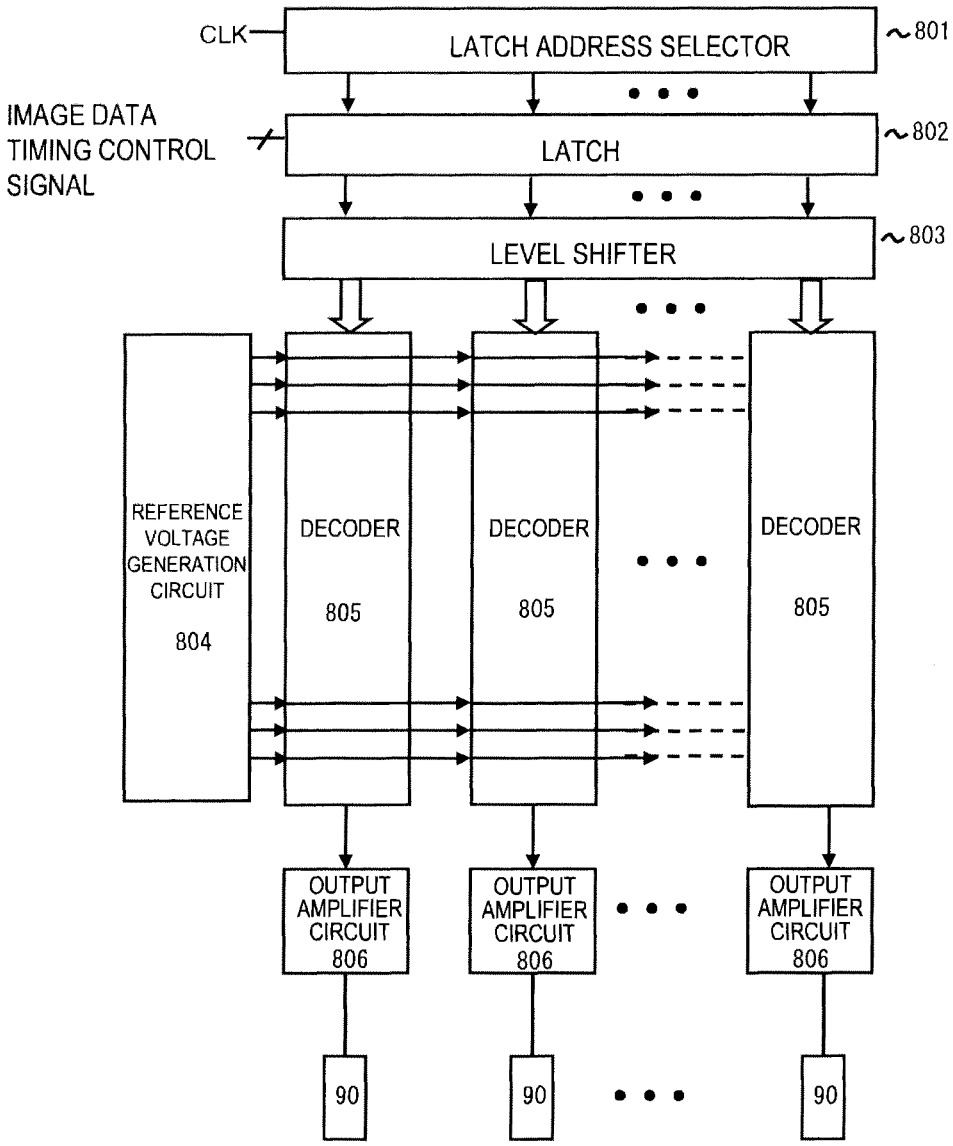
FIG. 16 is a diagram for explaining the configuration of a data driver of a sixth exemplary embodiment of the present invention.

FIG. 16 is a diagram showing the configuration of a sixth exemplary embodiment of the present invention. In FIG. 16, main parts of the configuration of a data driver for an organic EL (Organic Electro-Luminescence) display device comprising the decoder of the present example described above are shown in a form of a block diagram. With reference to FIG. 16, this data driver has the latch address selector 801, the latch 802, the level shifter 803, and the output amplifier circuits 806 configured identically to those in the data driver shown in FIG. 15. In FIG. 16, the reference voltage generation circuit 804 and the decoders 805 are configured differently from the reference voltage generation circuit 804 and the decoders 805. The decoders 805 can be constituted by the decoders shown in FIGS. 1 to 7.

Unlike an LCD driver, a driver for an organic EL display device does not perform polarity inversion drive. Therefore, the decoders 805 have no polarity, and the same decoder can be provided for each output.

The reference voltage generation circuit 804 generates reference voltage groups corresponding to the number of grayscales and supplied them to each of the decoders 805. The decoder 805 selects a reference voltage corresponding to received data and outputs the selected voltage to the output amplifier circuit 806 as a positive signal voltage.

When organic EL elements are constituted using different organic materials for each of RGB, grayscale signal voltages may vary greatly for each of RGB. In this case, the data driver may be configured in such a manner that the reference voltage generation circuit 804 generates different reference voltages for each of RGB, the generated reference voltages are supplied to the decoders 805 corresponding to each of RGB respectively, and each decoder 805 selects a reference voltage corresponding to the received data and outputs the selected voltage to the output amplifier circuit 806.

Exemplary Embodiment 7

Figure 17:
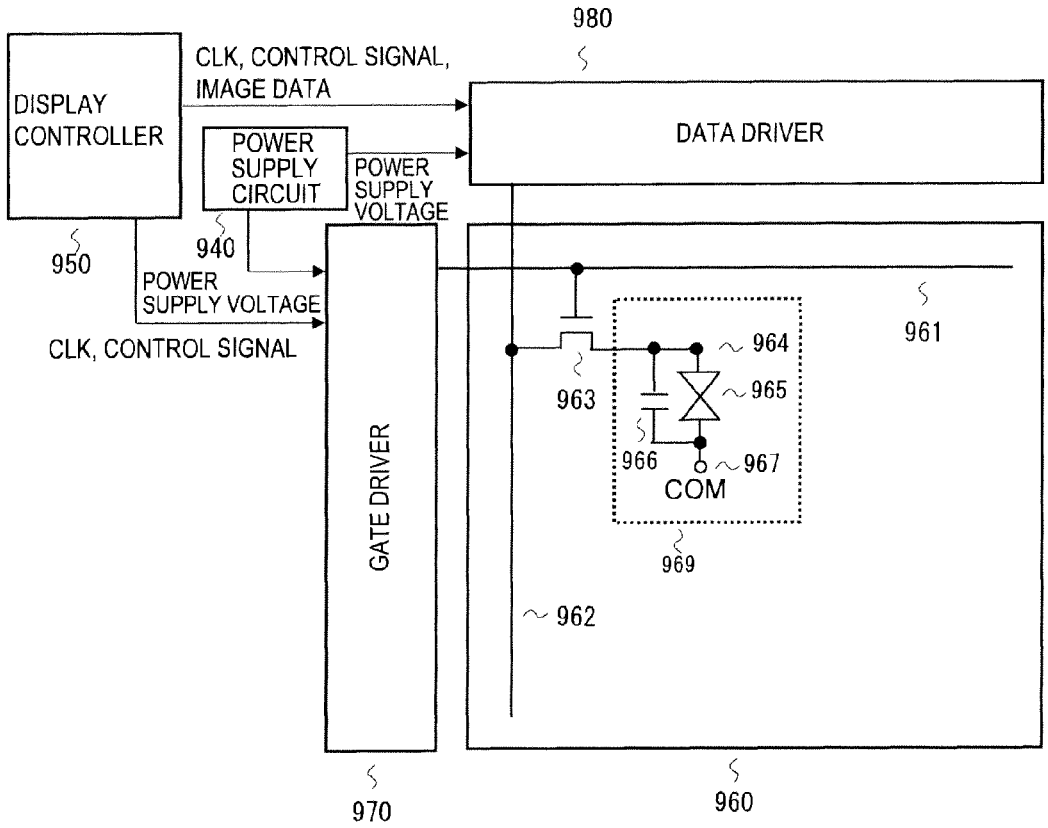
FIG. 17 is a diagram showing a configuration of an active-matrix type liquid crystal display device of a seventh exemplary embodiment of the present invention.

Next, with reference to FIG. 17, a typical configuration of an active-matrix type liquid crystal display device will be described as a display device to which the present invention is applied. In FIG. 17, the configuration of main parts connected to a pixel of the liquid crystal display is schematically shown using equivalent circuits. A display panel 960 of the active-matrix type liquid crystal display device comprises a semiconductor substrate on which transparent pixel electrodes 964 and thin film transistors (TFTs) 963 are arranged in a matrix (for instance 1280×3 pixel columns×1024 pixel rows in a case of a color SXGA (Super eXtended Graphics Array) panel), and a counter substrate with a transparent electrode 967 formed on the entire surface thereof, wherein a liquid crystal is enclosed and sealed between these two substrates facing each other. A display element 969 corresponding to a single pixel comprises a pixel electrode 964, a counter substrate electrode 967, a liquid crystal capacitor 965, and an auxiliary capacitor 966. A scan signal controls ON/OFF (conductive/nonconductive) state of the TFT 963 having a switching function. A grayscale signal voltage corresponding to an image data signal is applied to the pixel electrode 964 of the display element 969, when the TFT 963 are turned on (conductive). The transmittance of the liquid crystal changes in accordance with a potential difference between each pixel electrode 964 and the counter substrate electrode 967 and the display device displays an image by maintaining the potential difference using the liquid crystal capacitor 965 and the auxiliary capacitor 966, even after the TFT 963 is turned off (nonconductive).

Data lines 962 transmitting a plurality of the level voltages (the grayscale signal voltages) which is to be applied to each pixel electrode 964 and scan lines 961 transmitting the scan signal are wired in a grid pattern (1280×3 data lines and 1024 scan lines in the case of a color SXGA panel) on the semiconductor substrate, and the scan lines 961 and the data lines 962 become a large capacitive load due to a capacitance at each intersection of the lines and the liquid crystal capacitance interposed between the lines and the counter substrate electrode.

Further, a gate driver 970 supplies the scan signal to the scan lines 961 and a data driver 980 supplies the grayscale signal voltage to each pixel electrode 964 via the data lines 962. A display controller 950 controls the gate driver 970 and the data driver 980 supplying a clock CLK and a control signal required for each driver, and the image data is supplied to the data driver 980. Today, the image data is usually composed by digital data. Further, a power supply circuit 940 supplies a required power supply voltage to each driver.

Data for one screen is rewritten in one frame period (normally about 0.017 seconds when the display is driven at 60 Hz), each scan line sequentially selects a pixel row (line), and each data line supplies a grayscale voltage signal within the selection period. Further, there are cases where a scan line simultaneously selects a plurality of pixel rows or a display is driven at a frame frequency of 60 Hz or higher.

While the gate driver 970 is required to supply at least a binary scan signal, the data driver 980 is required to drive the data lines using multi-valued grayscale signal voltages corresponding to the number of grayscales. Because of this, the data driver 980 comprises a digital-to-analog converter circuit (DAC) including a decoder that converts image data into an analog voltage and an output amplifier that amplifies this analog voltage and outputs it to the data lines 962. A dot-inversion driving scheme capable of achieving a high-quality image is employed to drive a large-screen display device such as a monitor and a liquid crystal display television. In the dot-inversion driving scheme, in the display panel 960 shown in FIG. 17, a counter substrate electrode voltage VCOM is a constant voltage and voltage polarities held by neighboring pixels are reverse to each other. Therefore, voltage polarities outputted to neighboring data lines (962) are positive and negative relative to the counter substrate electrode voltage VCOM. Further, in dot-inversion driving scheme, the polarity of the data line is reversed normally at every horizontal period, however, in some dot-inversion driving methods, the polarity is reversed at every two horizontal periods in cases where the load capacitance of the data line increases greatly or the frame frequency is high. The configuration shown in FIG. 15 can be applied to the data driver 980.

Exemplary Embodiment 8

Figure 18:
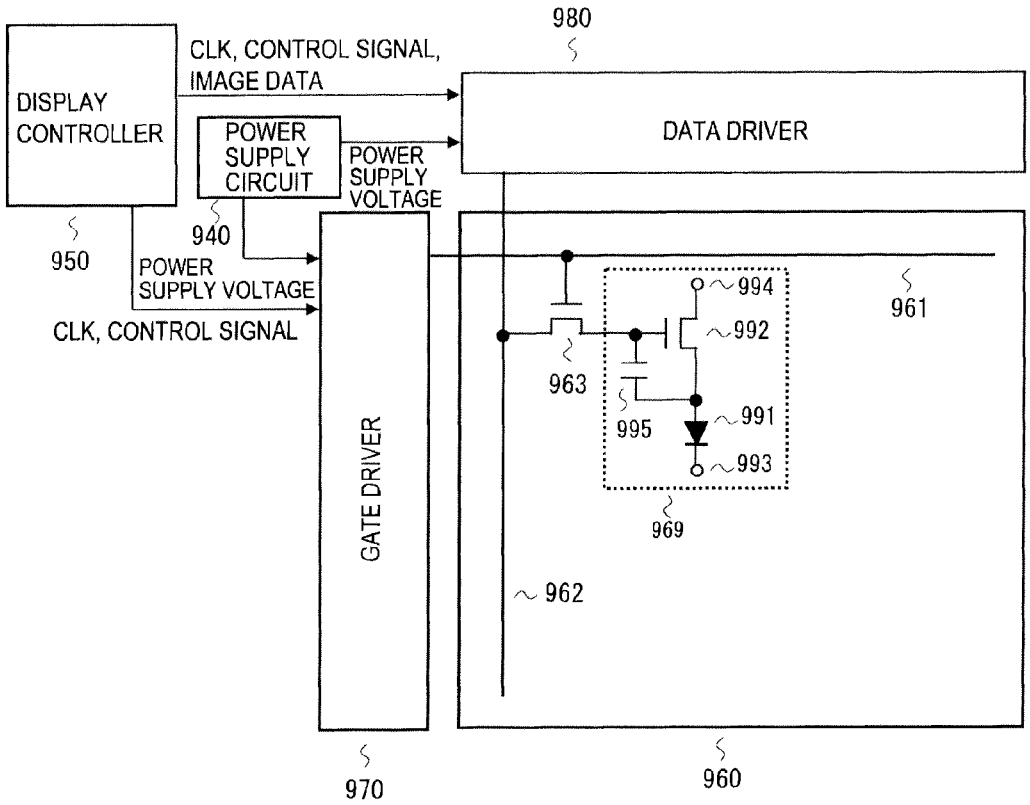
FIG. 18 is a diagram showing a configuration of an active-matrix type organic EL display device of an eighth exemplary embodiment of the present invention.

Next, with reference to FIG. 18, a typical configuration of an active-matrix type organic EL display device will be described as another display device to which the present invention is applied. In FIG. 18, the configuration of main parts connected to a pixel of the organic EL display is schematically shown using equivalent circuits. An organic EL display device can be driven using the following methods:

A current program method in which a current signal corresponding to a grayscale level is supplied to a data line.

A voltage program method in which a voltage signal corresponding to a grayscale level is supplied to a data line.

The present invention can be applied to the voltage program method. In FIG. 18, the display element 969 is structurally different from that in FIG. 17, and other elements are basically identical to those in FIG. 17.

On the display panel 960 of the organic EL display device in FIG. 18, the thin film transistors (TFTs) 963 having a switching function, thin film transistors (TFTs) 992 controlling a current supplied to an organic EL element 991, and the organic EL elements 991 comprised of an organic film interposed between two thin film electrode layers are arranged in a matrix. The TFT 992 and the organic EL element 991 are connected in series between a power supply terminal 994 and a cathode electrode 993, and there is also provided an auxiliary capacitor 995 holding a control terminal voltage of the TFT 992. Further, the display element 969 corresponding to a single pixel is composed by the TFT 992, the organic EL element 991, the power supply terminal 994, the cathode electrode 993, and the auxiliary capacitor 995.

A scan signal from the gate driver 970 controls ON/OFF (conductive/nonconductive) status of the TFT 963 having a switching function. A grayscale signal voltage corresponding to an image data signal is applied to the control terminal of the TFT 992 when the TFT 963 is turned on (conductive). A current corresponding to the grayscale signal voltage is supplied from the TFT 992 to the organic EL element 991 and the display device displays an image by having the organic EL element 991 emit light in response to the current. The configuration of the display device in FIG. 18 is basically identical to that of the liquid crystal display device in FIG. 17, except for the configuration of the display element 969; therefore an explanation of the other parts is omitted. The configuration shown in FIG. 16 can be applied to the data driver 980.

Although FIG. 18 shows an example in which the TFTs 963 and 992 are N-channel transistors, the TFTs 963 and 992 can be constituted by P-channel transistors. Further, the organic EL element may be connected to the power supply terminal 994. In this case, an output range of the data driver 980 is closer to the low-potential power supply VSS, and Vdif2 in FIG. 14B is closer to the high-potential power supply VDD. Therefore, the configurations shown in FIGS. 12 and 13 are suitable as a decoder in this case.

The disclosure of Patent Document is incorporated herein by reference thereto. It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A decoder receiving first and second reference voltage groups from a reference voltage generation circuit that outputs said first and second reference voltage groups belonging respectively to first and second voltage sections not overlapping each other, selecting a reference voltage from among said first and second reference voltage groups in accordance with a received digital signal and outputting a selected reference voltage, said decoder including:

a first sub-decoder receiving said first reference voltage group and selecting and outputting a reference voltage to an output terminal of said decoder, said first sub-decoder comprising a plurality of switches, each which includes a first transistor of a first conductivity type having a back gate supplied with a first power supply voltage;

a second sub-decoder receiving said second reference voltage group, said second sub-decoder comprising a plurality of switches, each of which includes a second transistor of said first conductivity type having a back gate supplied with a second power supply voltage, which is different from said first power supply voltage; and a third sub-decoder receiving at least a reference voltage selected by said second sub-decoder and selecting and outputting a reference voltage to said first sub-decoder or to said output terminal of said decoder, said third sub-decoder comprising at least one switch including a third transistor of said first conductivity type having a back gate supplied with said first power supply voltage;

said first power supply voltage being a first reference voltage, which is a voltage most spaced from said second voltage section among said first reference voltage group, or a predetermined voltage having a same magnitude relationship with said second voltage section as said first reference voltage and further spaced from said second voltage section than said first reference voltage, said second power supply voltage being a predetermined voltage within a range from a second reference voltage, which is a voltage closest to said first voltage section among said second reference voltage group, to a voltage within said first voltage section but not reaching said first reference voltage.

2. The decoder according to claim 1, wherein, when one of said first sub-decoder and said third sub-decoder selects and outputs a reference voltage selected from one of said first reference voltage group and said second reference voltage group to a connection node, at which an output node of said third sub-decoder and an predetermined internal node of said first sub-decoder are connected, a reference voltage from the other of said first sub-decoder and said third sub-decoder is not outputted to said connection node.

3. The decoder according to claim 1, wherein said third sub-decoder includes:

said third transistor of said first conductivity type; and a fourth transistor of a second conductivity type connected in parallel with said third transistor;

said third and fourth transistors arranged between a first connection node at which said third sub-decoder and said first sub-decoder are connected and a second connection node at which said third sub-decoder and said second sub-decoder are connected, said third and fourth transistors commonly controlled to be turned on and off.

4. The decoder according to claim 1, wherein said first conductivity type is P-type, a lower limit voltage of said first voltage section is greater than an upper limit voltage of said second voltage section, said first power supply voltage is set not less than an upper limit voltage of said first voltage section, and said second power supply voltage is set not less than said upper limit voltage of said second voltage section and less than said upper limit voltage of said first voltage section.

5. The decoder according to claim 1, wherein said first conductivity type is N-type, an upper limit voltage of said first voltage section is less than a lower limit voltage of said second voltage section, said first power supply voltage is set not more than a lower limit voltage of said first voltage section, and said second power supply voltage is set not more than said lower limit voltage of said second voltage section and more than said lower limit voltage of said first voltage section.

6. The decoder according to claim 1, wherein said second power supply voltage is supplied from one of a plurality of reference voltage groups supplied as said first or said second reference voltage groups.

7. The decoder according to claim 1, wherein said first sub-decoder comprises:

a first switch controlled to be turned on and off by one of a predetermined bit signal of said received digital signal and a complementary signal of said predetermined bit signal, said first switch including a first transistor of said first conductivity type having a back gate supplied with said first power supply voltage; and a second switch controlled to be turned on and off by one of a bit signal positioned lower by one bit than said predetermined bit signal and a complementary signal of said bit signal, said second switch including a first transistor of said first conductivity type having a back gate supplied with said first power supply voltage, and wherein said third sub-decoder comprises a third switch controlled to be turned on and off by the other of said bit signal lower by one bit than said predetermined bit signal and a complementary signal of said bit signal, said third switch including a third transistor of the first conductivity type having a back gate supplied with said first power supply voltage, an output end of said third switch, as an output end of said third sub-decoder, being coupled with an output end of said second switch in said first sub-decoder at a connection node, said connection node being connected to an input end of said first switch in said first sub-decoder.

8. The decoder according to claim 7, wherein said third switch comprises a fourth transistor of a conductivity type opposite to said first conductivity type juxtaposed with said third transistor of said first conductivity type, said third transistor and said fourth transistor being controlled in common to be turned on and off by a corresponding bit signal and a complementary signal of said corresponding bit signal.

9. The decoder according to claim 7, wherein said first and second voltage sections, said first power supply voltage, and said second power supply voltage are within a range between a high-potential power supply voltage and a low-potential power supply voltage of said decoder.

10. The decoder according to claim 1, wherein said first sub-decoder comprises first and second switches controlled to be turned on and off by an MSB (Most Significant Bit) signal of said received digital signal and a complementary signal of the MSB signal, respectively, each of said first and second switches including a first transistor of said first conductivity type having an output end connected to said output terminal of said decoder and having a back gate supplied with said first power supply voltage, when one of said first and second switches is turned on, a selected reference voltage that is selected by bit signals less significant than said MSB signal of said received digital signal, and transferred to an input end of said one of said first and second switches that is turned on, being outputted to said output terminal of said decoder, and wherein said third sub-decoder comprises a third switch controlled to be turned on and off by one of a bit signal lower by one bit than said MSB signal or a complementary signal of said bit signal, said third switch including a third transistor of the first conductivity type having a back gate supplied with said first power supply voltage, an output end of said third switch, as an output end of said third sub-decoder, being coupled with an output end of a fourth switch in said first sub-decoder at a connection node, said fourth switch including a first transistor of said first conductivity type having a back gate supplied with said first power supply voltage, said fourth switch controlled to be turned on and off by the other of said bit signal lower by one bit than said MSB signal and said complementary signal of said bit signal in said first sub-decoder, said connection node being connected to an input end of either said first or said second switches.

11. The decoder according to claim 1, wherein said first sub-decoder comprises a first switch and a second switch controlled to be turned on and off by an MSB (Most Significant Bit) signal of said received digital signal and a complementary signal of said MSB, respectively, each of said first switch and said second switch including a first transistor of said first conductivity type having an output end connected to the output terminal of said decoder and having a back gates supplied with said first power supply voltage, when one of said first and second switches is turned on, a selected reference voltage that is selected by bit signals less significant than said MSB signal of said received digital signal, and transferred to an input end of said one of said first and second switches that is turned on, being outputted to said output terminal of said decoder, and wherein said third sub-decoder comprises a third switch controlled to be turned on and off by one of said MSB signal and a complementary signal of said MSB, said third switch including a third transistor of said first conductivity type having a back gate supplied with said first power supply voltage, an output end of said third switch, as an output end of said third sub-decoder being connected to said output terminal of said decoder in common with said first switch and said second switch in said first sub-decoder.

12. The decoder according to claim 11, wherein said first conductivity type is P-type, and said second power supply voltage supplied to said back gate of said second transistor of said first conductivity type in said second sub-decoder is set greater than a maximum reference voltage selected and outputted by a switch controlled to be turned on, simultaneously with said third switch, out of said first and said second switches provided in said first sub-decoder.

13. A data driver apparatus comprising:

a reference voltage generation circuit outputting first and second reference voltage groups respectively belonging to first and second voltage sections not overlapping each other;

a decoder receiving said first and said second reference voltage groups, and outputting a voltage selected in accordance with a received digital signal including a digital image signal; and an output amplifier circuit receiving, amplifying, and outputting an output of said decoder to a data line connected to a display element on a display panel, wherein said decoder includes:

a first sub-decoder receiving said first reference voltage group and selecting and outputting a reference voltage to an output terminal of said decoder, said first sub-decoder comprising a plurality of switches, each of which includes a first transistor of a first conductivity type having a back gate supplied with a first power supply voltage;

a second sub-decoder receiving said second reference voltage group, said second sub-decoder comprising a plurality of second switches, each of which includes a second transistor of said first conductivity type having a back gate supplied with a second power supply voltage, which is different from said first power supply voltage; and a third sub-decoder receiving at least a reference voltage selected by said second sub-decoder, and selecting and outputting a reference voltage to said first sub-decoder or to said output terminal of said decoder, said third sub-decoder comprising at least one switch including a third transistor of said first conductivity type having a back gate supplied with said first power supply voltage;

said first power supply voltage being a first reference voltage, which is a voltage most spaced from said second voltage section among said first reference voltage group, or a predetermined voltage having a same magnitude relationship with said second voltage section as said first reference voltage and further spaced from said second voltage section than said first reference voltage, said second power supply voltage being a predetermined voltage within a range from a second reference voltage, which is a voltage closest to said first voltage section among said second reference voltage group, to a voltage within said first voltage section but not reaching said first reference voltage.

14. The data driver apparatus according to claim 13, wherein said display element is a liquid crystal element or an organic electro-luminescence element.

15. The data driver apparatus according to claim 13, wherein said third sub-decoder in said decoder includes:

said third transistor of said first conductivity type; and a fourth transistor of a second conductivity type connected in parallel with said third transistor;

said third and fourth transistors arranged between a first connection node at which said third sub-decoder and said first sub-decoder are connected and a second connection node at which said third sub-decoder and said second sub-decoder are connected, said third and fourth transistors commonly controlled to be turned on and off.

16. The data driver apparatus according to claim 13, wherein said first conductivity type is P-type, a lower limit voltage of said first voltage section is greater than an upper limit voltage of said second voltage section, said first power supply voltage is set not less than an upper limit voltage of said first voltage section, and said second power supply voltage is set not less than said upper limit voltage of said second voltage section and less than said upper limit voltage of said first voltage section.

17. The data driver apparatus according to claim 13, wherein said first conductivity type is N-type, an upper limit voltage of said first voltage section is less than a lower limit voltage of said second voltage section, said first power supply voltage is set not more than a lower limit voltage of said first voltage section, and said second power supply voltage is set not more than said lower limit voltage of said second voltage section and more than said lower limit voltage of said first voltage section.

18. The data driver apparatus according to claim 13, wherein said first sub-decoder in said decoder comprises:

a first switch controlled to be turned on and off by one of a predetermined bit signal of said received digital signal and a complementary signal of said predetermined bit signal, said first switch including a first transistor of said first conductivity type having a back gate supplied with said first power supply voltage; and a second switch controlled to be turned on and off by one of a bit signal positioned lower by one bit than said predetermined bit signal and a complementary signal of said predetermined bit signal, said second switch including a first transistor of said first conductivity type having a back gate supplied with said first power supply voltage, and wherein said third sub-decoder in said decoder comprises a third switch controlled to be turned on and off by the other of said bit signal lower by one bit than said predetermined bit signal and a complementary signal of said bit signal, said third switch including a third transistor of the first conductivity type having a back gate supplied with said first power supply voltage, an output end of said third switch, as an output end of said third sub-decoder, being coupled with an output end of said second switch in said first sub-decoder at a connection node, said connection node being connected to an input end of said first switch in said first sub-decoder.

19. A display device comprising said data driver apparatus according to claim 13.

* * * * *